US011559463B2

(12) United States Patent
Kajihara et al.

(10) Patent No.: US 11,559,463 B2
(45) Date of Patent: Jan. 24, 2023

(54) METHOD FOR PRODUCING PORT, AND METHOD FOR PRODUCING MEDICAL LIQUID BAG

(71) Applicant: Otsuka Pharmaceutical Factory, Inc., Tokushima (JP)

(72) Inventors: Yasuyuki Kajihara, Tokushima (JP); Hidenari Shoji, Tokushima (JP); Masamichi Okubata, Tokushima (JP); Fumito Uesugi, Tokushima (JP); Ryuta Kazumori, Tokushima (JP)

(73) Assignee: Otsuka Pharmaceutical Factory, Inc., Tokushima (JP)

( * ) Notice: Subject to any disclaimer, the term of this patent is extended or adjusted under 35 U.S.C. 154(b) by 144 days.

(21) Appl. No.: 15/544,479

(22) PCT Filed: Jan. 20, 2016

(86) PCT No.: PCT/JP2016/051490
§ 371 (c)(1),
(2) Date: Jul. 18, 2017

(87) PCT Pub. No.: WO2016/117580
PCT Pub. Date: Jul. 28, 2016

(65) Prior Publication Data

US 2018/0263847 A1 Sep. 20, 2018

(30) Foreign Application Priority Data

Jan. 21, 2015 (JP) ..... JP2015-009480

(51) Int. Cl.
*A61J 1/10* (2006.01)
*B65B 3/00* (2006.01)
(Continued)

(52) U.S. Cl.
CPC ..... *A61J 1/10* (2013.01); *A61J 1/1406* (2013.01); *A61J 1/1475* (2013.01); *A61J 1/1487* (2015.05);
(Continued)

(58) Field of Classification Search
CPC ..... B65B 7/2821; B65B 3/003; A61J 1/00; A61J 1/10; A61J 1/1475; A61J 1/1487; A61J 1/201; A61J 1/1406; A61J 1/1431
(Continued)

(56) References Cited

U.S. PATENT DOCUMENTS 7,658,279 B2 2/2010 Oka et al.
8,641,012 B2 2/2014 Matsumoto et al.
(Continued)

FOREIGN PATENT DOCUMENTS

CN 1795026 A 6/2006
CN 102264433 A 11/2011
(Continued)

OTHER PUBLICATIONS

Translation of JPH-07-148225 (Year: 2019).*
(Continued)

*Primary Examiner* — Anna K Kinsaul
*Assistant Examiner* — Veronica Martin
(74) *Attorney, Agent, or Firm* — Brooks Kushman P.C.

(57) ABSTRACT

An object is to provide a method for producing a port that can shorten the time for production. Provided is a method for producing a port including: sealingly inserting a sealing plug, through which a hollow needle can be pierced, into a part to be sealed of a port body, wherein the port body includes: a part to be sealed that has a tubular shape with a first end and a second end opposite to the first end; a connection part that has a tubular shape, and is continuous with the first end of the part to be sealed; and the part to be
(Continued)

fitted that is formed in any one of an inner peripheral surface of the part to be sealed, an outer peripheral surface of the part to be sealed, and the second end of the part to be sealed; fitting a fitting part of a pulling-out prevention member into the part to be fitted, wherein the pulling-out prevention member includes: a body part that has a first surface and a second surface opposite to the first surface, and the fitting part that is continuous with the body part; and laying the body part on the sealing plug.

20 Claims, 23 Drawing Sheets

(51) Int. Cl.

| | |
|---|---|
| ***B65B 3/02*** | (2006.01) |
| ***B65B 3/04*** | (2006.01) |
| ***A61J 1/14*** | (2006.01) |
| ***A61J 1/20*** | (2006.01) |

(52) U.S. Cl.
CPC ..... *A61J 1/201* (2015.05); *B65B 3/003* (2013.01); *B65B 3/02* (2013.01); *B65B 3/04* (2013.01); *A61J 1/1431* (2015.05)

(58) Field of Classification Search
USPC ... 53/410, 412, 133.1, 468, 471, 284.7, 489, 53/319; 215/247, 249
See application file for complete search history.

(56) References Cited

U.S. PATENT DOCUMENTS

| | | | | |
|---|---|---|---|---|
| 2006/0138069 | A1* | 6/2006 | Domkowski | A61J 1/10 215/247 |
| 2007/0066941 | A1 | 3/2007 | Tezuka et al. | |
| 2011/0233435 | A1* | 9/2011 | Matsumoto | A61M 39/045 251/192 |

FOREIGN PATENT DOCUMENTS

| | | | | | |
|---|---|---|---|---|---|
| EP | 1491177 | A1 | | 12/2004 | |
| EP | 1625873 | A1 | | 2/2006 | |
| EP | 2394691 | A1 | | 12/2011 | |
| JP | H-06-225922 | | * | 8/1994 | |
| JP | JH06-225922 | A | | 8/1994 | |
| JP | 07148225 | A | * | 6/1995 | B65D 75/5883 |
| JP | H-07-148225 | | * | 6/1995 | |
| JP | H07-148225 | A | | 6/1995 | |
| JP | 2003-111819 | A | | 4/2003 | |
| JP | 2003111819 | A | * | 4/2003 | |
| JP | 2005-349182 | A | | 12/2005 | |
| JP | 2009-013285 | A | | 1/2009 | |
| JP | JH2012-000288 | A | | 1/2012 | |
| TW | 200303193 | A | | 9/2003 | |
| WO | WO2010/073643 | A | | 7/2010 | |

OTHER PUBLICATIONS

Translation of JPH-06-225922 (Year: 2019).*
JP2003-111819A Machine Translation (Year: 2020).*
JPH-07-148225 Machine Translation (Year: 2019).*
Tateishi, Machine Translation of JP-2003111819-A, 2003 (Year: 2022).*
Fujio, Machine Translation of JP 07-148225, 1995 (Year: 2022).*
English translation of the International Preliminary Report dated Jul. 27, 2017 in connection with PCT/JP2016/051490.
European Search Report dated Aug. 9, 2018 in connection with European Patent Appl. No. 16740187.6.
Chinese Office Action dated Sep. 4, 2019 in connection with related Chinese Patent Appl. No. 201680006233.X.
Taiwanese Office Action dated Nov. 14, 2019 in connection with related Taiwanese Application No. 105101732.
Korean Office Action dated Jun. 16, 2020 in connection with related Korean Patent Appl. No. 2017-7020562.

* cited by examiner

METHOD FOR PRODUCING PORT, AND METHOD FOR PRODUCING MEDICAL LIQUID BAG

CROSS-REFERENCE TO RELATED APPLICATION

This application claims the benefit of Japanese Patent Application No. 2015-009480, which is incorporated herein by reference.

FIELD OF THE INVENTION

The present invention relates to a method for producing a port to be attached to a bag body that stores a medical liquid, and a method for producing a medical liquid bag provided with the port.

BACKGROUND ART

Hitherto, there has been provided a medical liquid bag that stores a medical liquid (e.g., a liquid containing a medical agent, and a liquid containing a nutritional supplement). As shown in FIG. 22, such a medical liquid bag 4 includes a bag body 40, the inside of which is filled with a medical liquid, and a port 41 attached to the bag body (e.g., Patent Literature 1).

The bag body 40 includes a pair of sheet members 400 that face each other. The pair of sheet members 400 have outer peripheral edges welded together.

As shown in FIG. 23, the port 41 includes a sealing plug 410 through which a hollow needle can be pierced, and a port body 411 having a hollow structure with the sealing plug 410 disposed therein.

The port body 411 includes a part 411*a* to be sealed having a tubular shape into which the sealing plug 410 is sealingly inserted, and a connection part 411*b* that is continuous with the part 411*a* to be sealed, has an inside communicating with an inside of the part 411*a* to be sealed, and has an outer periphery to which the pair of sheet members 400 are respectively welded.

The port body 411 includes a pulling-out prevention part 411*c* that is continuous with the part 411*a* to be sealed and is configured to abut against the sealing plug 410. The pulling-out prevention part 411*c* presses the sealing plug 410. Whereby, the pulling-out prevention part 411*c* prevents the sealing plug 410 from being pulled out of the port body 411.

Meanwhile, in the process of producing the medical liquid bag 4, it takes a time to produce (process) the bag body 40, the port 41 and the like.

For example, in the process of producing the port 41, an extension extending from the part 411*a* to be sealed (hereinafter referred to as the "bending margin 411*d*") is bent toward the sealing plug 410 while being heated to have its entirety of a leading end portion of the bending margin 411*d* abutting against the sealing plug 410 and thereby the bending margin 411*d* is formed into the pulling-out prevention part 411*c*. Thus, in the conventional production method, it is necessary to subject the bending margin 411*d* to heating, bending and the like, which requires time.

Therefore, there is a demand for shortening the time for producing the bag body 40, the port 41 and the like during the production process of the medical liquid bag 4.

PRIOR ART LITERATURE

Patent Literature

[Patent Literature 1] JP 2005-349182 A

SUMMARY OF THE INVENTION

Problem to be Solved by the Invention

In view of the above circumstances, an object of the present invention is to provide a method for producing a port that can shorten the time for production, and a method for producing a medical liquid bag.

Means to Solve the Problem

According to the present invention, there is provided a method for producing a port comprising: sealingly inserting a sealing plug, through which a hollow needle can be pierced, into a part to be sealed of a port body, wherein the port body includes: a part to be sealed that has a tubular shape with a first end and a second end opposite to the first end in a center axis direction thereof; a connection part that has a tubular shape, and is continuous with the first end of the part to be sealed; and the part to be fitted that is formed in any one of an inner peripheral surface of the part to be sealed, an outer peripheral surface of the part to be sealed, and the second end of the part to be sealed; fitting a fitting part of a pulling-out prevention member into the part to be fitted, wherein the pulling-out prevention member includes: a body part that has a first surface and a second surface opposite to the first surface, and the fitting part that is continuous with the body part, to thereby engage the part to be fitted with the fitting part so as to be able to transmit a force which is directed in the center axis of the part to be sealed; and laying the body part on the sealing plug.

According to the present invention, there is provided a method for producing a port comprising: sealingly inserting a sealing plug, through which a hollow needle can be pierced, into a part to be sealed of a port body, wherein the port body includes: a part to be sealed that has a tubular shape with a first end and a second end opposite to the first end in a center axis direction thereof; a connection part that has a tubular shape, and is continuous with the first end of the part to be sealed; and the part to be fitted that is formed in any one of an inner peripheral surface of the part to be sealed, an outer peripheral surface of the part to be sealed, and the second end of the part to be sealed; fitting a fitting part of a pulling-out prevention member into the part to be fitted, wherein the pulling-out prevention member includes: a body part that has a first surface and a second surface opposite to the first surface, and the fitting part that is continuous with the body part, to thereby make an engaging surface of the part to be fitted that is directed toward the first end side of the part to be sealed face an engaging surface of the fitting part that is directed toward the second end side of the part to be sealed; and laying the body part on the sealing plug It may be configured so that the part to be fitted is any one of a recess part and a projection part, and the fitting part is a remaining one of the recess part and the projection part.

Further, it may be configured so that the body part has a needle insertion portion that opens to the first surface and the second surface and exposes the sealing plug, wherein the sealing plug includes a projection part that projects toward the needle insertion portion of the body part, and laying the body part on the sealing plug encompasses disposing the projection part of the sealing plug within the needle insertion portion while any one of the first surface and the second surface of the body part is directed toward the sealing plug, and disposing an end of the projection part at the same level as or substantially the same level as a remaining one of the first surface and the second surface of the body part, or at a position where the end of the projection part projects outward from a remaining one of the first surface and the second surface of the body part.

Further, it may be configured so that the pulling-out preventing member includes a first restriction part that is formed on the first surface of the body part, and laying the body part on the sealing plug encompasses bringing the first restriction part into abutting engagement with the sealing plug.

Further, it may be configured so that the pulling-out preventing member includes a second restriction part that is formed on the second surface of the body part, and laying the body part on the sealing plug encompasses bringing any one of the first restriction part and the second restriction part into abutting engagement with the sealing plug.

According to the present invention, there is also provided a method for producing a medical liquid bag comprising: sealingly inserting a sealing plug, through which a hollow needle can be pierced, into a part to be sealed of a port body, wherein the port body includes: a part to be sealed that has a tubular shape with a first end and a second end opposite to the first end in a center axis direction thereof; a connection part that has a tubular shape, and is continuous with the first end of the part to be sealed; and the part to be fitted that is formed in any one of an inner peripheral surface of the part to be sealed, an outer peripheral surface of the part to be sealed, and the second end of the part to be sealed; fitting a fitting part of a pulling-out prevention member into the part to be fitted, wherein the pulling-out prevention member includes: a body part that has a first surface and a second surface opposite to the first surface, and the fitting part that is continuous with the body part, to thereby engage the part to be fitted with the fitting part so as to be able to transmit a force which is directed in the center axis of the part to be sealed; laying the body part on the sealing plug; and connecting a bag body to be filled with a medical liquid to an outer periphery of the connection part.

According to the present invention, there is provided a method for producing a medical liquid bag comprising: sealingly inserting a sealing plug, through which a hollow needle can be pierced, into a part to be sealed of a port body, wherein the port body includes: a part to be sealed that has a tubular shape with a first end and a second end opposite to the first end in a center axis direction thereof; a connection part that has a tubular shape, and is continuous with the first end of the part to be sealed; and the part to be fitted that is formed in any one of an inner peripheral surface of the part to be sealed, an outer peripheral surface of the part to be sealed, and the second end of the part to be sealed; fitting a fitting part of a pulling-out prevention member into the part to be fitted, wherein the pulling-out prevention member includes: a body part that has a first surface and a second surface opposite to the first surface, and the fitting part that is continuous with the body part, to thereby make an engaging surface of the part to be fitted that is directed toward the first end side of the part to be sealed face an engaging surface of the fitting part that is directed toward the second end side of the part to be sealed; laying the body part on the sealing plug; and connecting a bag body to be filled with a medical liquid to an outer periphery of the connection part It may be configured so that the part to be fitted is any one of a recess part and a projection part, and the fitting part is a remaining one of the recess part and the projection part.

Further, it may be configured so that the method further includes: filling a medical liquid into the bag body via the port body to which the connection part of the bag body is connected, wherein sealingly inserting the sealing plug into the part to be sealed and laying the body part on the sealing plug are carried out after the medical liquid is filled in the bag body.

Separately from the above, it may be configured so that a non-sealed portion provided in the bag body is sealed after the medical liquid is filled in the bag body through the non-sealed portion.

Further, it may be configured so that connecting the bag body to the outer periphery of the connection part encompasses sealing the non-sealed portion by welding the non-sealed portion to the connection part disposed at the non-sealed portion.

DETAILED DESCRIPTION OF THE PREFERRED EMBODIMENT

The description is given for one embodiment of the present invention with reference to the drawings attached hereto.

Figure 1:
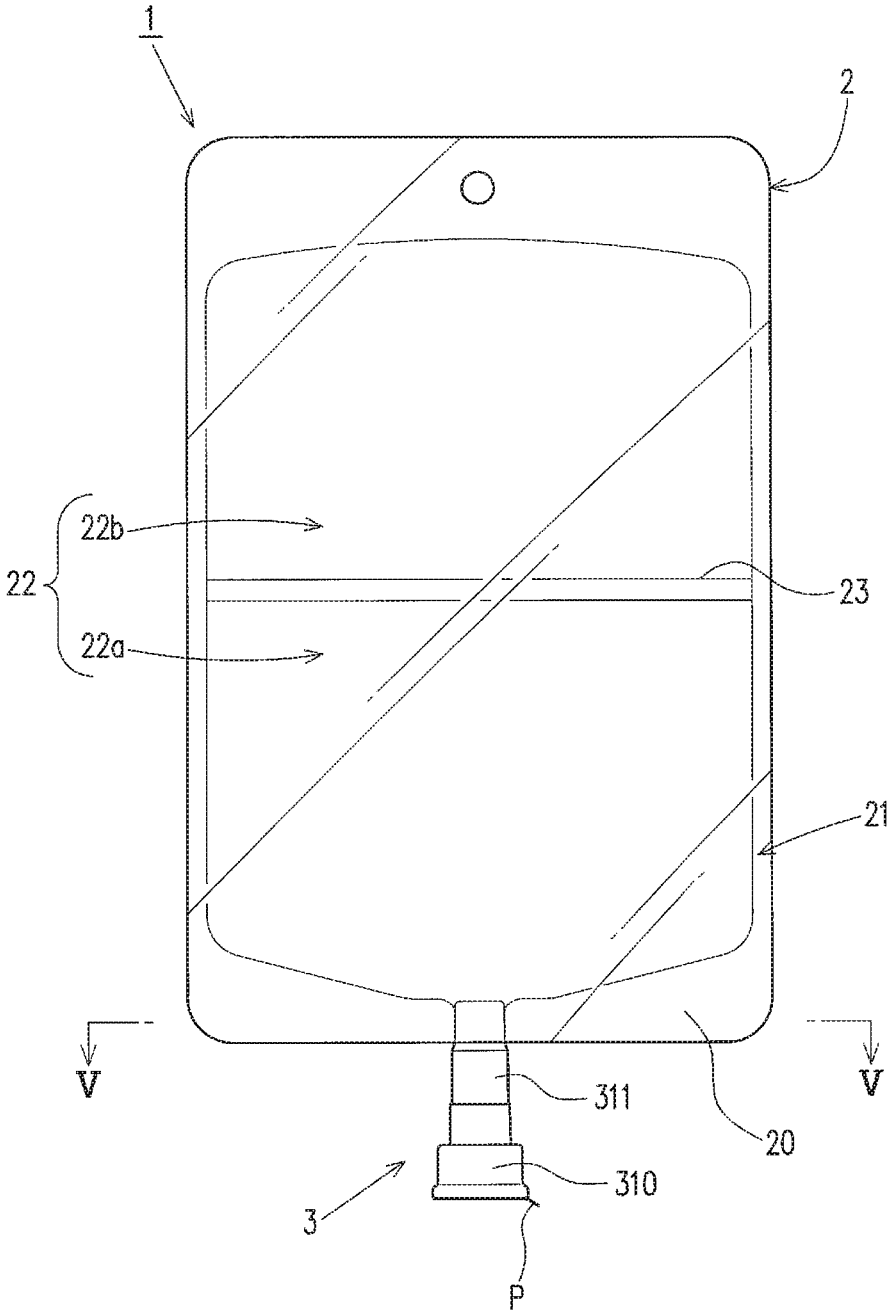
FIG. 1 is a front view of a medical liquid bag according to one embodiment of the present invention.

As shown in FIG. 1, a medical liquid bag 1 includes a bag body 2 that is configured to be filled with a medical liquid (e.g., a liquid containing a medical agent for infusion, and a liquid containing a nutritional supplement), and a port 3 attached to the bag body 2.

The bag body 2 includes a pair of opposite sheet members 30 overlapping each other. The bag body 2 includes a seal part 21 formed by welding the outer circumferential edges of the opposite sheet members 20. The bag body 2 includes a storage chamber 22 defined by the pair of sheet members 20 and the seal part 21.

In the present embodiment, the bag body 2 includes a weak seal part 23 formed by separably bonding the pair of sheet members 20.

The weak seal part 23 is formed to partition the storage chamber 22 into plural spaces. In the present embodiment, the weak seal part 23 partitions the storage chamber 22 into two spaces. That is, the storage chamber 22 includes two spaces 22*a* and 22*b* that can communicate with each other. In the present embodiment, a description is given with one space 22*a* of the storage chamber 22 being served as a first storage chamber and another space 22*b* of the storage chamber 22 being served as a second storage chamber.

The first storage chamber 22*a* and the second storage chamber 22*b* respectively store therein different kinds of medical liquid. In the bag body 2, when the weak seal part 23 is ruptured, the first storage chamber 22*a* and the second storage chamber 22*b* come into communication with each other. Whereby, a medical liquid within the first storage chamber 22*a* is mixed with a medical liquid within the second storage chamber 22*b*.

Figure 2:
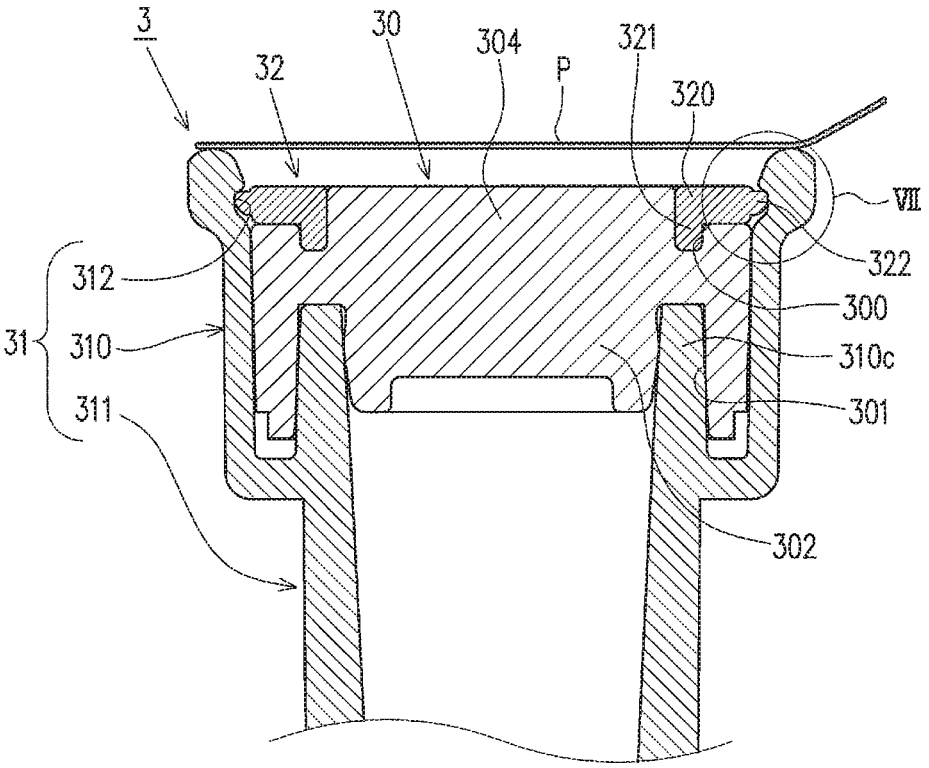
FIG. 2 is a longitudinal cross section of a port according to the one embodiment.

As shown in FIG. 2, the port 3 includes a sealing plug 30 through which a hollow needle can be pierced, a port body 31 having a hollow structure with the sealing plug 30 disposed therein, and a pulling-out preventing member 32 to be attached to the port body 31.

Figure 3:
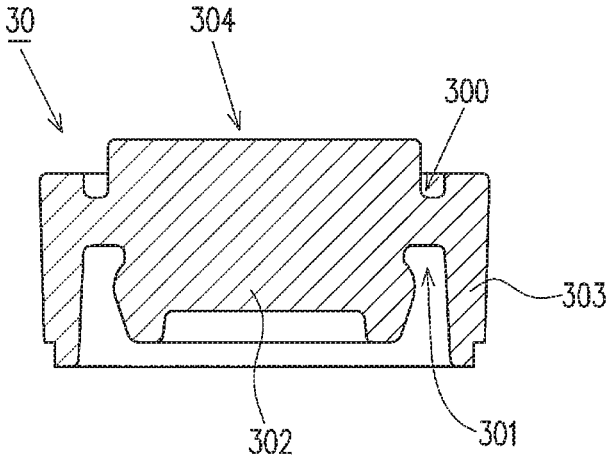
FIG. 3 is a longitudinal cross section of a sealing plug according to the one embodiment.

The sealing plug 30 has a first surface located on a pulling-out preventing member 32 side and a second surface located opposite to the first surface. As shown in FIG. 3, the sealing plug 30 has an annular groove 300 formed on the first surface.

A center portion of the first surface of the sealing plug 30 (a portion inward of the groove 300 of the first surface) has a height higher than an outer peripheral edge of the first surface of the sealing plug 30 (higher than a portion outward of the groove 300 of the first surface). That is, the center portion of the first surface of the sealing plug 30 is located closer to the pulling-out preventing member 32 in the center axis direction than the outer peripheral edge of the first surface of the sealing plug 30 is. More specifically, the sealing plug 30 includes a projection part 304 that projects toward an inside of an area surrounded by the pulling-out preventing member 32 (a through-hole of a later described body part 320) (see FIG. 2). In the present embodiment, the projection part 304 is a part surrounded by the groove 300 of the sealing plug 30. The projection part 304 projects further outward than an outer peripheral edge portion of the first surface of the sealing plug 30 in a center axis direction of the port body 31.

With the above configuration, the center portion (the projection part 304) of the first surface of the sealing plug 30 can be easily subjected to various workings (e.g., disinfecting with alcohol).

The sealing plug 30 has an annular recess part 301 opened toward the side opposite to the pulling-out preventing member 32 side (see FIG. 2). That is, the sealing plug 30 has the annular recess part 301 formed in the second surface.

The sealing plug 30 has an extension 302 that extends toward a side opposite to the pulling-out preventing member 32 (the first surface) side from the center portion of the second surface, and an annular projection part 303 that surrounds an outer peripheral surface of the extension 302.

The extension 302 is surrounded by the annular recess part 301. That is, the extension 302 is formed in an area inside of the annular recess part 301 of the second surface of the sealing plug 30. On the other hand, the annular projection part 303 is formed in an area outside the annular recess part 301 of the second surface of the sealing plug 30. With this configuration, the outer peripheral surface of the extension 302 and the inner peripheral surface of the annular projection part 303 face each other with the annular recess part 301 therebetween. The outer peripheral surface of the extension 302 bulges toward the annular projection part 303 over the entire periphery in the circumferential direction.

Figure 4:
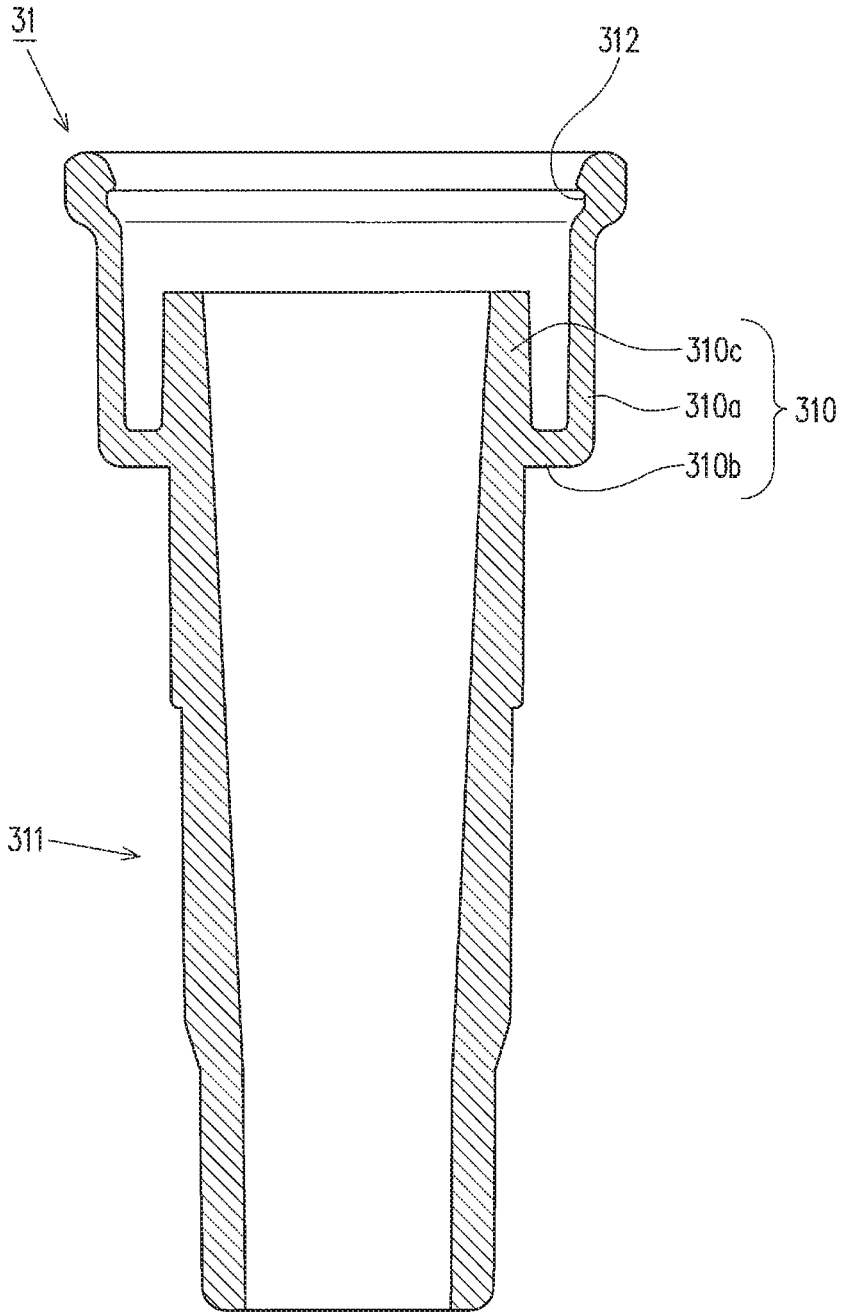
FIG. 4 is a longitudinal cross section of a port body according to the one embodiment.

As shown in FIG. 4, the port body 31 includes a part 310 to be sealed that has a tubular shape with a first end and a second end opposite to the first end in the center axis direction, and is configured so that the sealing plug 30 is sealingly inserted into the part 310 to be sealed, a connection part 311 that has a tubular shape, is continuous with the first end of the part 310 to be sealed, and has an outer periphery welded to the bag body 2, and a part 312 to be fitted that is formed in any one of an inner peripheral surface of the part 310 to be sealed, an outer peripheral surface of the part 310 to be sealed, and the second end of the part 310 to be sealed.

The part 310 to be sealed of the present embodiment includes an outer wall part 310*a* having a tubular shape, and a continuous part 310*b* for connection between the outer wall part 310*a* and the connection part 311.

The outer wall part 310*a* has a first end and a second end opposite to the first end in the center axis direction. The first end of the outer wall part 310*a* is continuous with the connection part 311 via the continuous part 310*b*.

The outer wall part 310*a* has an inner peripheral surface to come into contact with the outer peripheral surface of the sealing plug 30 over the entire periphery in the circumferential direction. A recess part (groove) as the part 312 to be fitted extends continuously in the circumferential direction in the inner peripheral surface on the second end side of the outer wall part 310*a*. A peelable seal P is applied to the second end of the part 310 to be sealed (outer wall part 310*a*) according to the present embodiment (see FIG. 2).

The thickness of the second end of the outer wall part 310*a* is set to be greater than the thickness of the first end of the outer wall part 310*a*. With this, the second end side of the outer wall part 310*a* has a rigidity higher than the rigidity of the first end side of the outer wall part 310*a*.

The continuous part 310*b* extends from the first end of the outer wall part 310*a* over the entire periphery in the circumferential direction toward an inner side in a radial direction. The continuous part 310*b* has an inner peripheral edge being continuous with the connection part 311.

The part 310 to be sealed further includes an annular support part 310*c* that extends from the continuous part 310*b* toward the second end of the outer wall part 310*a*. In the part 310 to be sealed, the outer peripheral surface of the support part 310*c* and the inner peripheral surface of the outer wall part 310*a* face each other with a distance from each other. That is, in the part 310 to be sealed, a clearance is formed between the outer peripheral surface of the support part 310*c* and the inner peripheral surface of the outer wall part 310*a*.

As shown in FIG. 2, in the port 3 according to the present embodiment, the extension 302 of the sealing plug 30 is sealingly inserted into or is disposed in the inside of the support part 310*c*. Along with this, the support part 310*c* is sealingly inserted into or is disposed in the annular recess part 301 of the sealing plug 30.

As described above, the outer peripheral surface of the extension 302 bulges toward the annular projection part 303 over the entire periphery in the circumferential direction. With this, the extension 302 of the sealing plug 30 more tightly contacts the support part 310*c*.

As shown in FIG. 4, the connection part 311 extends from the first end of the part 310 to be sealed. Specifically, the connection part 311 has a first opening end and a second opening end opposite to the first opening end in the center axis direction. In the present embodiment, the first opening end of the connection part 311 is continuous with the part 310 to be sealed. The pair of sheet members 20 each are welded to the outer peripheral surface on the second end side of the connection part 311 (see FIG. 1).

Figure 5:
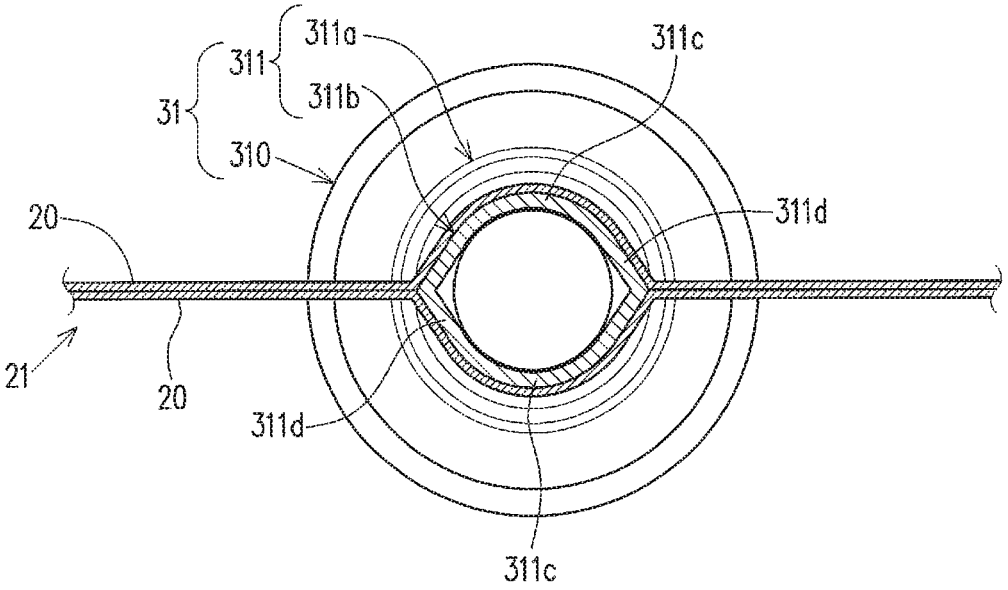
FIG. 5 is a cross section of a port according to the one embodiment, and a cross section taken along a line V-V in FIG. 1.

As shown in FIG. 5, the connection part 311 includes a tubular part 311*a* that provides communication between the inside of itself and the inside of the part 310 to be sealed, and a part 311*b* to be attached that is connected to the tubular part 311*a* and provides communication between the inside of itself and the inside of the tubular part 311*a*.

The outer diameter of the tubular part 311*a* is smaller than the outer diameter of the part 310 to be sealed.

The part 311*b* to be attached includes a pair of circular arc parts 311*c* that are located opposite to each other with a distance in a first direction orthogonal to the center axis direction of the port body 31 and bulge or project toward the outside, and a pair of sharp pointed parts 311*d* that are located opposite to each other with a distance in a second direction orthogonal to the center axis direction of the port body 31 and the first direction and connect corresponding end portions of the pair of circular arc parts 311*c* to each other.

The pair of sharp pointed parts 311*d* respectively have outer surfaces that project respectively in the opposite directions. That is, the outer surfaces of the pair of sharp pointed parts 311*d* project outward. The outer surfaces of the pair of sharp pointed parts 311*d* each taper off to a point as it advances toward the outside in the second direction.

The outer surfaces of the pair of circular arc parts 311*c* are respectively continuous with the outer surfaces of the pair of sharp pointed parts 311*d*. In the present embodiment, the thickness of the circular arc parts 311*c* is equal to or substantially equal to the thickness of the sharp pointed parts 311*d*. As the result, the inner surfaces of the pair of circular arc parts 311*c* are also continuous with the inner surfaces of the pair of sharp pointed parts 311*d*. The inner diameter in the second direction of the part 311*b* to be attached is larger than the inner diameter in the first direction of the part 311*b* to be attached. The outer diameter of the part 311*b* to be attached is smaller than the outer diameter of the tubular part 311*a*. That is, the outer diameter (outer size) in the second direction of the part 311*b* to be attached is smaller than the outer diameter of the tubular part 311*a*.

As shown in FIG. 4, the part 312 to be fitted is a recess part formed in the inner peripheral surface of the part 310 to be sealed. The part 312 (recess part) to be fitted according to the present embodiment continuously extends in the inner peripheral surface of the part 310 to be sealed over the entire periphery in the circumferential direction. That is, the part 312 to be fitted (recess part) 312 has an endless annular shape. In the present embodiment, the part 312 (recess part) to be fitted is formed in the inner peripheral surface on the second end side of the outer wall part 310*a*.

Figure 6:
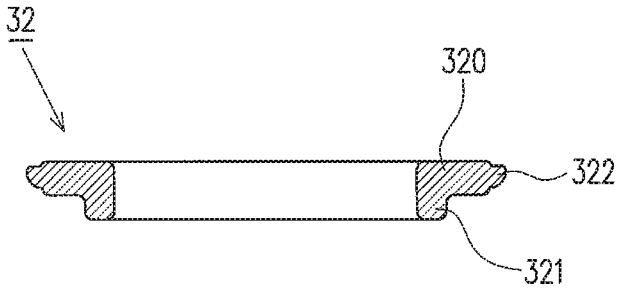
FIG. 6 is a longitudinal cross section of a pulling-out prevention member according to the one embodiment.

As shown in FIG. 2, the pulling-out preventing member 32 is laid on the first surface of the sealing plug 30, which first surface faces outward within the part 310 to be sealed. As shown in FIG. 6, the pulling-out preventing member 32 has a needle insertion portion into which a hollow needle is inserted. In the present embodiment, the needle insertion portion is a through-hole, and in compliance with this, the pulling-out preventing member 32 has an annular shape.

More specifically, the pulling-out preventing member 32 includes a body part 320 that has a first surface and a second surface opposite to the first surface, a restriction part 321 that is formed on the first surface of the body part 320, and a fitting part 322 that is continuous with the outer periphery of the body part 320.

The body part 320 has a needle insertion portion that opens to the first surface and the second surface and exposes the sealing plug 30. As described above, the needle insertion portion is a through-hole. In compliance with this, the body part 320 defines the through-hole (the needle insertion portion) and has an annular shape. In the present embodiment, the needle insertion portion (the through-hole) is a circular hole. In compliance with this, the body part 320 has an annular shape.

The first surface of the body part 320 includes a facing area that faces an outwardly facing surface of the sealing plug 30 disposed within the part 310 to be sealed (the first surface of the sealing plug 30). The body part 320 has an annular shape and accordingly the facing area is an annular shaped area having an outer periphery defined by the outer periphery of the body part 320. The first surface of the body part 320 faces inward (the sealing plug 30 side) within the part 310 to be sealed, and the second surface of the body part 320 faces outward within the part 310 to be sealed. The second surface of the body part 320 is disposed at the same level as or substantially the same level as (on the plane of) the first surface of the sealing plug 30 (in the present embodiment, an end of the projection part 304). A more specific description is given. The second surface (outer surface) of the body part 320 has a flat surface shape. The second surface (outer surface) of the body part 320 is located at a position matching to or substantially matching to the first surface of the sealing plug 30 (matching to the center portion of the first surface of the sealing plug 30 in the present embodiment) in the center axis direction of the port body 31.

The restriction part 321 surrounds the needle insertion portion (the through-hole) of the body part 320. The restriction part 321 projects toward the sealing plug 30 from the first surface of the body part 320. The restriction part 321 projects toward the sealing plug 30 from an area of the first surface excluding the facing area that faces the sealing plug 30. In the present embodiment, the restriction part 321 projects toward the sealing plug 30 from an annular area located on the inner peripheral side of the facing area of the first surface of the body part 320. The restriction part 321 is disposed within the groove 300 of the sealing plug 30. In the present embodiment, the restriction part 321 abuts against the sealing plug 30.

As described above, in the pulling-out preventing member 32 according to the present embodiment, the restriction part 321 projecting from the first surface of the body part 320 is disposed within the groove 300 of the sealing plug 30. Along with this, the pulling-out preventing member 32 comes into abutting engagement with the sealing plug 30 through not only the restriction part 321 but also the facing area of the first surface of the body part 320.

The restriction part 321 is formed on the inner peripheral edge side of the body part 320. Therefore, in the pulling-out preventing member 32, the thickness on the inner peripheral edge side of the annular body part 320 is greater than the thickness on the outer peripheral edge side of the body part 320. Whereby, the inner peripheral edge side of the pulling-out preventing member 32 has a higher rigidity.

As described above, the part 312 to be fitted of the port body 31 is a recess part that is formed in the inner peripheral surface of the part 310 to be sealed and continuously extends in the inner peripheral surface of the part 310 to be sealed over the entire periphery in the circumferential direction. In compliance with this, the fitting part 322 is a projection part that extends radially outwardly from the outer peripheral surface of the body part 320 and continuously extends in the outer peripheral surface of the body part 320 over the entire periphery in the circumferential direction.

The fitting part 322 has a proximal end that is connected to the body part 320, and a distal end that is located opposite to the proximal end. The entire periphery in the circumferential direction of the fitting part 322 abuts against the part 312 to be fitted of the port body 31.

Figure 7:
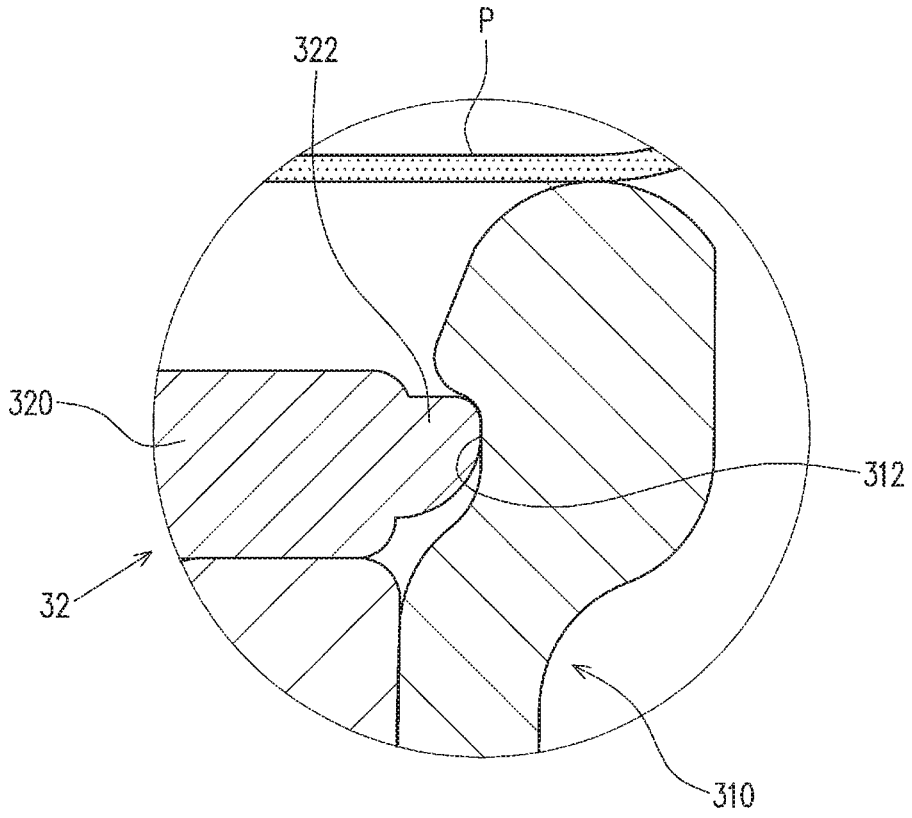
FIG. 7 is an enlarged view of the port according to the one embodiment, and is an enlarged view of an area VII of FIG. 2.

In the present embodiment, the entire periphery in the circumferential direction of the fitting part 322 of the pulling-out preventing member 32 comes into line contact with or into partial surface contact with the part 312 to be fitted of the port body 31. A more specific description is given. As shown in FIG. 7, the part 312 to be fitted of the port body 31 and the fitting part 322 (outer peripheral surface) each have an arc shape. The curvature of the part 312 to be fitted is smaller than the curvature of the outer peripheral surface of the fitting part 322 of the pulling-out preventing member 32. With this configuration, the entire periphery in the circumferential direction of the fitting part 322 comes into line contact with or into partial surface contact with the part 312 to be fitted of the port body 31.

The medical liquid bag 1 is as described above. Now, the description is given for a method for producing the port 3, and a method for producing the medical liquid bag 1.

First, the description is given for a method for producing the port 3. The sealing plug 30, the port body 31, and the pulling-out preventing member 32 are respectively formed in advance by molding, and are prepared as parts of the port 3.

Specifically, as shown in FIG. 4, the port body 31 is formed in advance by molding, which includes the part 310 to be sealed that has a tubular shape with the first end and the second end opposite to the first end in the center axis direction, the connection part 311 having a tubular shape that is connected to the first end of the part 310 to be sealed, and the part 312 to be fitted (the recess part in the present embodiment) formed in the inner peripheral surface of the part 310 to be sealed. Also, as shown in FIG. 3, the sealing plug 30 is formed in advance by molding, which includes the first surface and the second surface opposite to the first surface, and is configured to allow a hollow needle to be pierced through itself and be sealingly inserted into the part 310 to be sealed. Further, as shown in FIG. 6, the pulling-out preventing member 32 is formed in advance by molding, which includes the body part 320 that is laid on the first surface of the sealing plug 30, and the fitting part 322 that is provided along the outer periphery of the body part 320 and can be fitted into the part 312 to be fitted. Here, it is to be noted that, in the molding step of the port body 31, the connection part 311 and the part 310 to be sealed are integrally molded. However, it may be configured so that the connection part 311 and the part 310 to be sealed are separately molded and the connection part 311 and the part 310 to be sealed are connected to each other.

As shown in FIG. 2, the sealing plug 30 is sealingly inserted into the part 310 to be sealed of the port body 31. As the result, the support part 310*c* of the part 310 to be sealed is forced into the annular recess part 301 of the sealing plug 30, and the outer peripheral surface of the extension 302 and the inner peripheral surface of the support part 310*c* are brought into tight contact with each other.

Under the above state, the fitting part 322 of the pulling-out preventing member 32 is fitted into the part 312 to be fitted of the port body 31. That is, the fitting part 322 of the pulling-out preventing member 32 is fitted into the part 312 to be fitted of the port body 31, and the body part 320 of the pulling-out preventing member 32 is laid on the sealing plug 30 within the part 310 to be sealed. Whereby, the restriction part 321 formed on the first surface of the body part 320 abuts against the sealing plug 30 (see FIG. 2).

A more specific description is given. Along with the fitting engagement between the fitting part 322 of the pulling-out preventing member 32 and the part 312 to be fitted of the port body 31, the restriction part 321 formed on the inner peripheral edge side of the body part 320 is disposed within the groove 300 of the sealing plug 30. With this, the facing area (outer peripheral edge portion) of the first surface of the body part 320, as well as the restriction part 321 abut against the sealing plug 30.

As the result, subsequent to attaching the pulling-out preventing member 32 to the port body 31, the pulling-out preventing member 32 comes into a state where it presses the sealing plug 30. Thus, the port 3 can be produced.

Now, the description is given for a method for producing the medical liquid bag 1.

In the method for producing the medical liquid bag 1, the port 3 and the pair of sheet members 20 for forming the bag body 2 are prepared in advance as the parts of the medical liquid bag 1. In the present embodiment, the inside of the bag body 2 is filled with a medical liquid via the port 3. Thus, the port 3 is prepared in uncompleted form. That is, the port 3 is prepared in such a state where the sealing plug 30 and the pulling-out preventing member 32 are detached from the port body 31.

Figure 8:
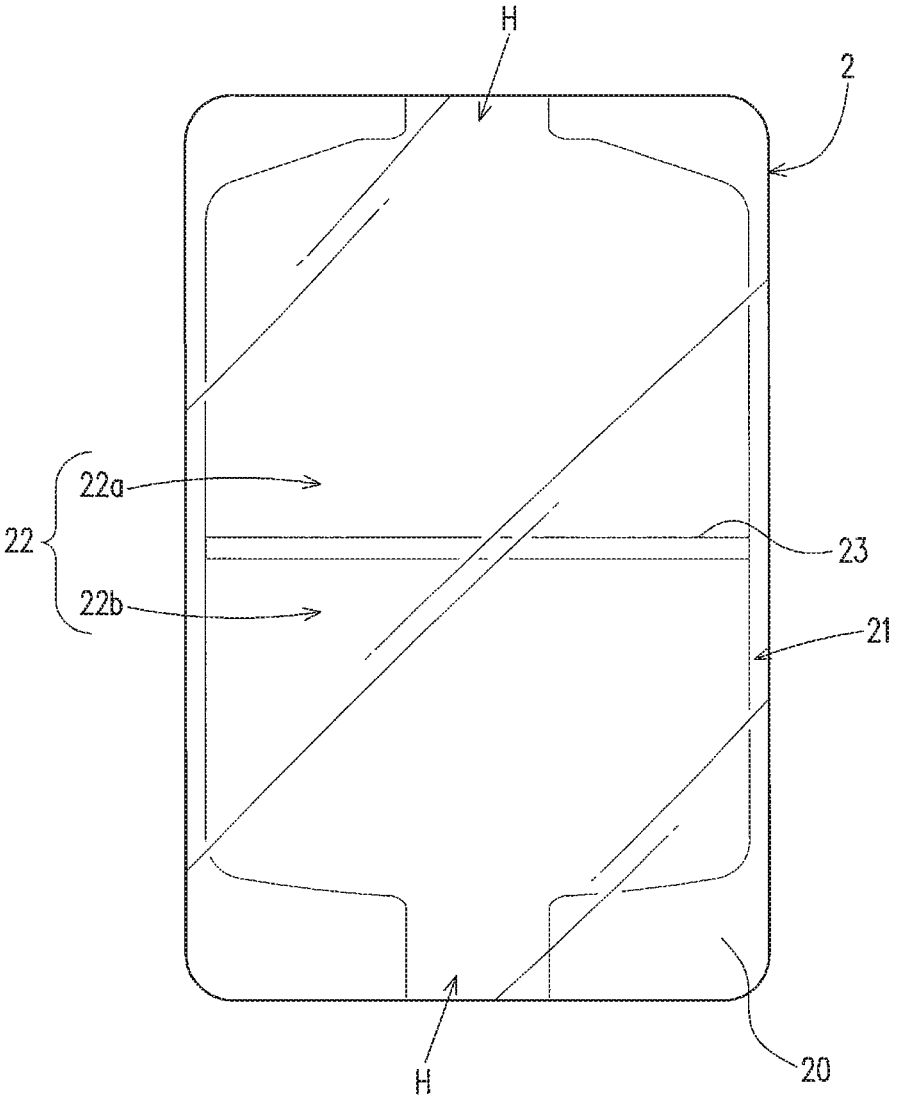
FIG. 8 is an explanatory view for a method for producing a medical liquid bag according to the one embodiment, showing a state before a port body is mounted to a bag body.

As shown in FIG. 8, first, the pair of sheet members 20 are overlapped with each other and the outer peripheral edge portions of the pair of sheet members 20 other than a part thereof are welded together. With this, the seal part 21 where the outer peripheral edge portions of the pair of sheet members 20 are connected together, and a non-sealed portion H where the outer peripheral edge portions of the pair of sheet members 20 are not connected together are formed. The non-sealed portion H or non-sealed portions H are provided corresponding in number to the space or spaces between the pair of sheet members 20. That is, the non-sealed portion H is provided as a portion through which a medical liquid is injected into the space between the pair of sheet members 20.

In the present embodiment, the pair of sheet members 20 are separably welded at an intermediate position thereof to form a weak seal portion 23 that partitions the inner space (storage chamber) 22 into plural spaces 22*a* and 22*b* (the first storage chamber 22*a* and the second storage chamber 22*b*). With this, the inner space (storage chamber) 22 surrounded by the seal part 21 where the outer peripheral edge portion of the pair of sheet members 20 are connected together is partitioned into plural spaces 22*a* and 22*b* (the first storage chamber 22*a* and the second storage chamber 22*b*) by the weak seal portion 23. In compliance with this, the non-sealed portion H is provided to correspond to each of the plural spaces 22*a* and 22*b* (the first storage chamber 22*a* and the second storage chamber 22*b*) partitioned by the weak seal portion 23.

At least one of the non-sealed portions H forms a clearance through which the connection part 311 of the port body 31 is inserted into between the pair of sheet members 20 (between the outer peripheral edge portions of the pair of sheet members 20). That is, one of the non-sealed portions H acts as an insertion port into which the connection part 311 of the port body 31 inserted. In the present embodiment, in compliance with the configuration in which the inner space (storage chamber) 22 between the pair of sheet members 20 is partitioned into the plural (two) spaces 22*a* and 2*b* (the first storage chamber 22*a* and the second storage chamber 22*b*), the plural (two) non-sealed portions H are provided. At least one of the non-sealed portions H acts as an insertion port for the connection part 311, and the remaining non-sealed portion(s) H acts as a fill port for a medical liquid.

Figure 9:
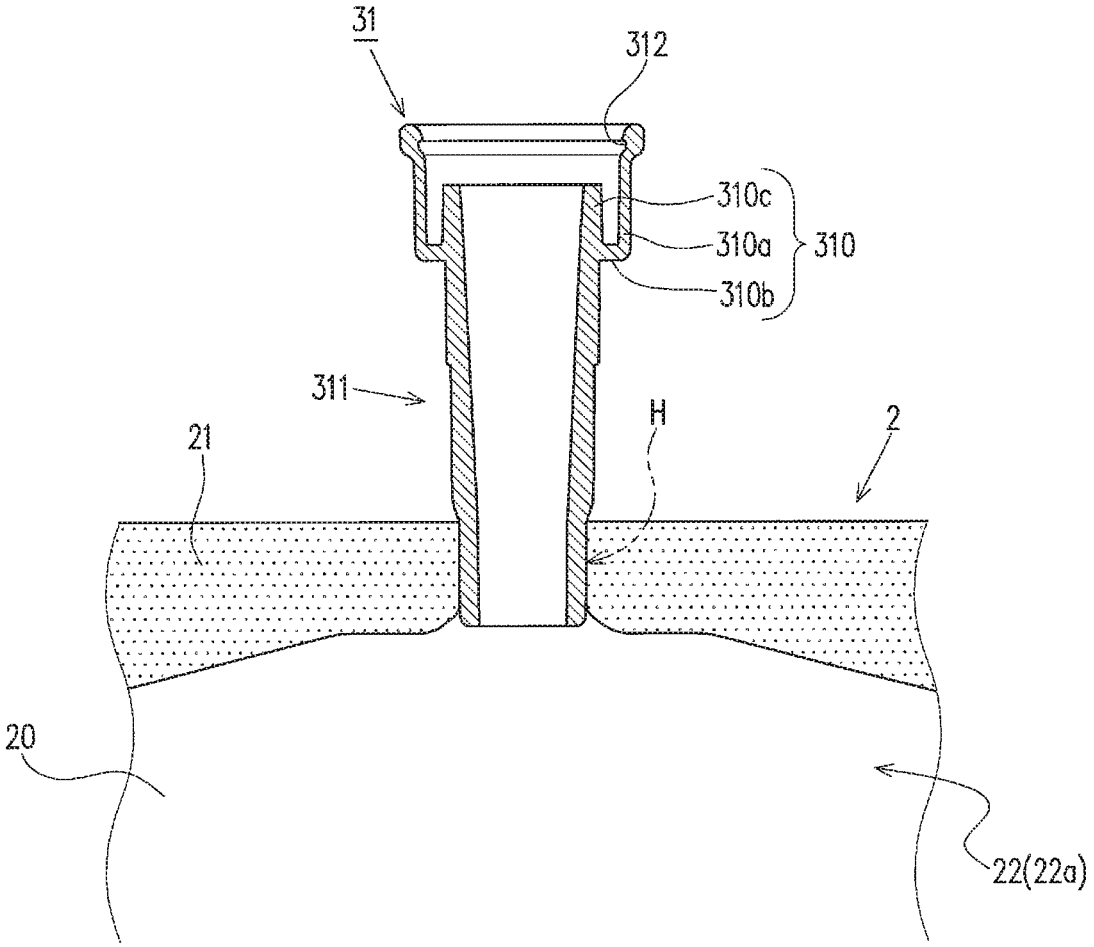
FIG. 9 is an explanatory view for a method for producing a medical liquid bag according to the one embodiment, showing a state after the port body is mounted to the bag body.

According to the above configuration, as shown in FIG. 9, the connection part 311 of the port body 31 is inserted into the non-sealed portion H that acts as the insertion port, and the pair of sheet members 20 are welded to the outer periphery of the part 311*b* to be attached of the connection part 311.

When the pair of sheet members 20 are welded to the part 311*b* to be attached, a pair of dies hold therebetween the non-sealed portion H together with the part 311*b* to be attached, and heat them. Whereby, the pair of sheet members 20 (the non-sealed portion H) and the part 311*b* to be attached are molten and blended together so that the non-sealed portion H is liquid-tightly connected to the port body 31.

Then, a medical liquid is filled into the inner space (storage chamber) 22 between the pair of sheet members 20 through the non-sealed portion H.

Figure 10:
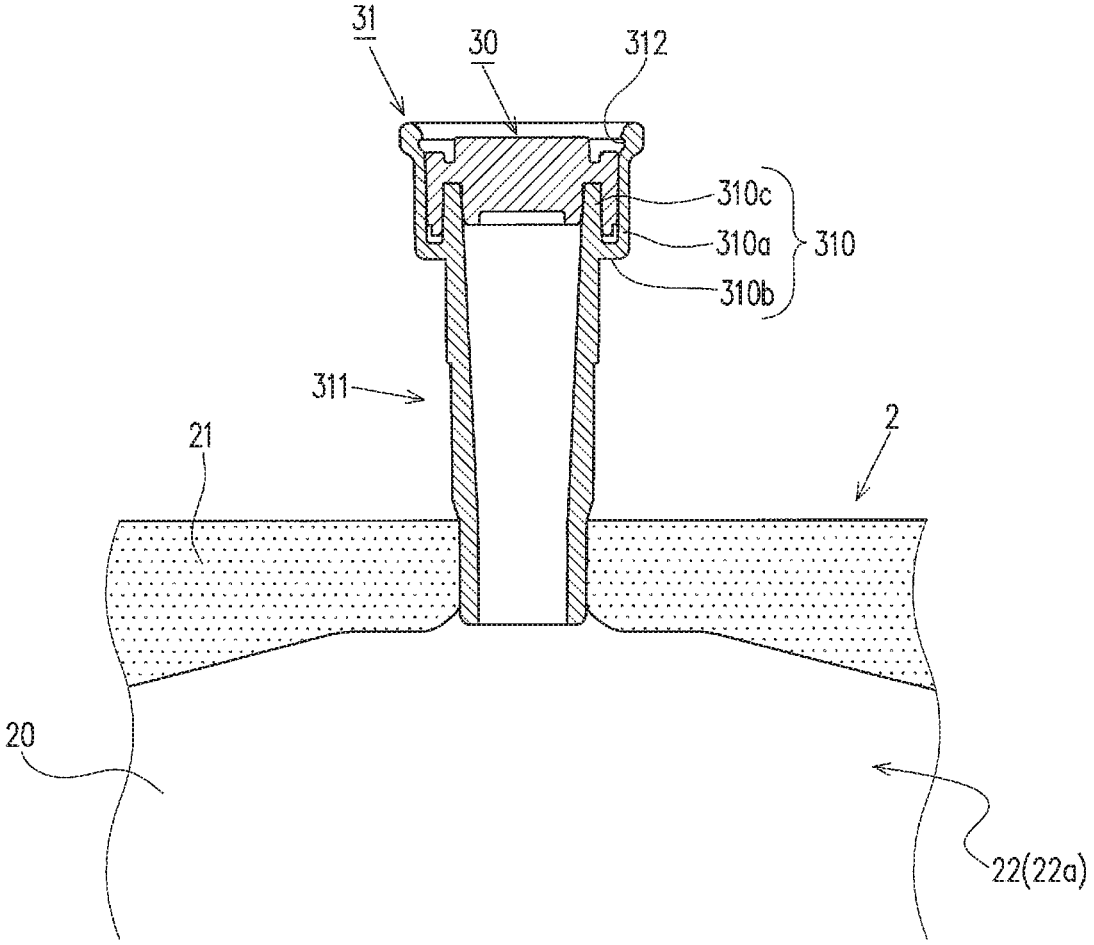
FIG. 10 is an explanatory view for a method for producing a medical liquid bag according to the one embodiment, showing a state after a sealing plug is sealingly inserted into a port body.

In the present embodiment, the one space (the first storage chamber) 22*a* of the two spaces 22*a* and 22*b* (the first storage chamber 22*a* and the second storage chamber 22*b*) partitioned by the weak seal portion 23 is filled with a medical liquid through the port body 31 connected to the non-sealed portion H. Subsequent to the filling the medical liquid into the one space (the first storage chamber) 22*a*, the sealing plug 30 is sealingly fitted into the part 310 to be sealed of the port body 31, as shown in FIG. 10. Whereby, the one space (the first storage chamber) 22*a* is sealed while it is filled with the medical liquid.

Figure 11:
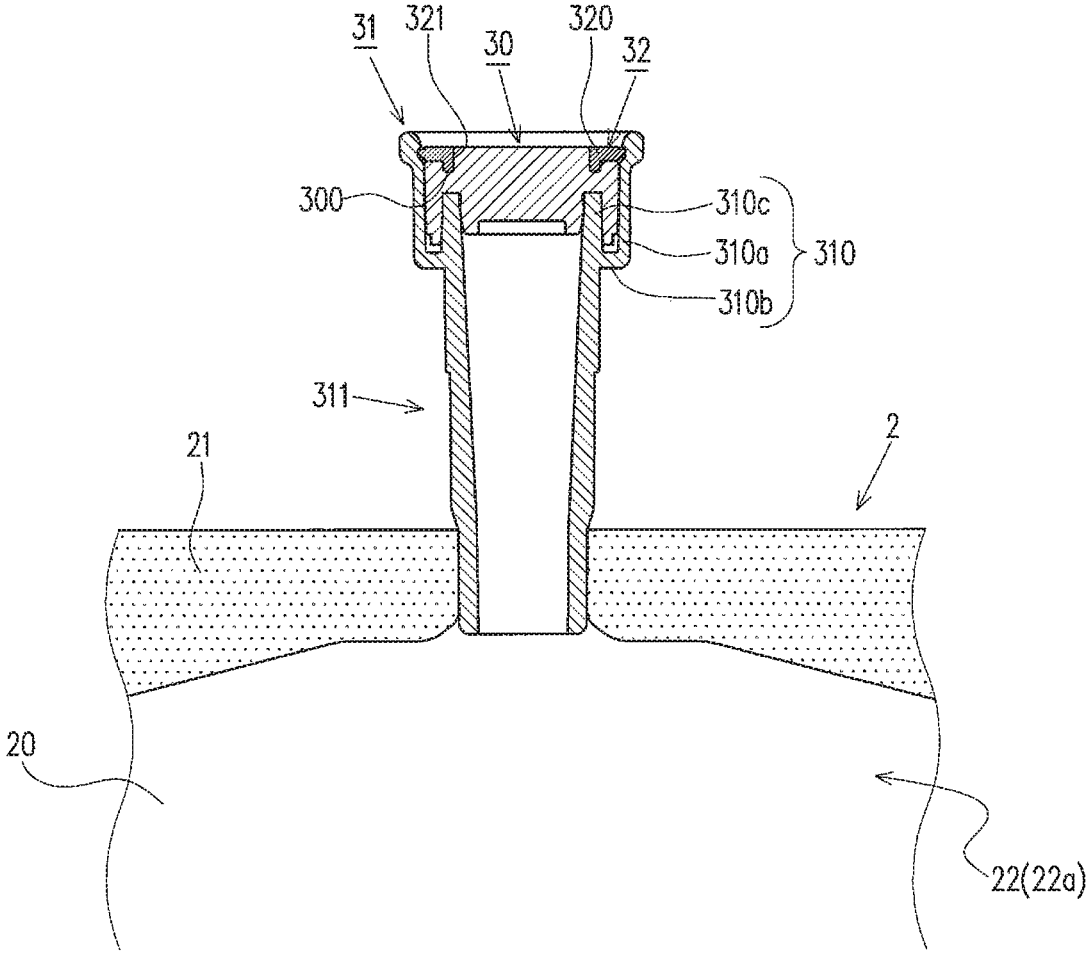
FIG. 11 is an explanatory view for a method for producing a medical liquid bag according to the one embodiment, showing a state where a pulling-out prevention member is fitted into the port body.

Then, as shown in FIG. 11, the pulling-out preventing member 32 is attached to the port body 31. Specifically, the fitting part 322 of the pulling-out preventing member 32 is fitted into the part 312 to be fitted of the port body 31. Along with this, the restriction part 321 formed on the first surface of the body part 320 abuts against the sealing plug 30.

In the present embodiment, when the fitting part 322 of the pulling-out preventing member 32 is fitted into the part 312 to be fitted of the port body 31, the restriction part 321 formed on the inner peripheral edge side of the body part 320 is disposed within the groove 300 of the sealing plug 30. Under this state, the restriction part 321 abuts against the sealing plug 30. In the present embodiment, the outer peripheral edge portion (the facing area) of the first surface of the body part 320, as well as the restriction part 321 abut against the sealing plug 30. That is, the sealing plug 30 is prevented from being pulled out, in the state where it is pressed by the pulling-out preventing member 32.

On the other hand, the other space (the second storage chamber) 22*b* of the two spaces 22*a* and 22*b* (the first storage chamber 22*a* and the second storage chamber 22*b*) partitioned by the weak seal portion 23 is directly filled with a medical liquid through the remaining non-sealed portion H. Subsequent to filling the medical liquid into the other space (the second storage chamber) 22*b*, the pair of sheet members 20, which constitute the non-sealed portion H corresponding to the other space (second storage chamber) 22*b*, are welded together, so that the non-sealed portion H is sealed. Whereby, the other space (the second storage chamber) 22*b* with the medical liquid filled therein is sealed, and the medical liquid bag 1 is produced.

Both of the production process of the port 3 and the production process of the medical liquid bag 1 may include a step of, after the pulling-out preventing member 32 is attached to the port body 31, removably binding the peelable seal P, which covers the sealing plug 30 and the pulling-out preventing member 32, to the second end of the part 310 to be sealed, or carrying out sterilization (for example, sterilization with hot water or steam).

As described above, according to the method for producing the port 3 and the method for producing the medical liquid bag 1, since the fitting part 322 of the pulling-out preventing member 32 is fitted into the part 312 to be fitted of the port body 31, and the body part 320 is laid on the sealing plug 30, the sealing plug 30 can be prevented from being pulled out of the port body 31 while the pulling-out preventing member 32 can be easily attached to the port body 31.

Also, since the part 312 to be fitted is formed by the recessed part, and the fitting part 322 is formed by the projection part which is fitted into the recess part of the part 312 to be fitted, the pulling-out preventing member 32 can be securely fixed to the port body 31.

Further, along with the fitting engagement between the fitting part 322 of the pulling-out preventing member 32 and the part 312 to be fitted of the port body 31, the restriction part 321 of the pulling-out preventing member 32 abuts against the sealing plug 30. Whereby, the sealing plug 30 within the port body 31 is pressed by the pulling-out preventing member 32 so that the sealing plug 30 can be more securely prevented from being pulled out of the port body 31.

Accordingly, the method for producing the port 3 and the method for producing the medical liquid bag 1 make it possible to produce the port 3 that can securely prevent the sealing plug 30 from being pulled out of the port body 31, while shortening the time for production. Also, since the port 3 is configured so that the fitting part 322 of the pulling-out preventing member 32 is fitted into the part 312 to be fitted of the port body 31, it is not necessary to carry out heating or bending process which was needed for the conventional port, and thus efficient assembly can be made.

Specifically, in the method for producing a conventional port, the port body is subjected to a bending process after the sealing plug is sealingly fitted into the port body, and thereby a pulling-out preventing part which presses the sealing plug is formed. Therefore, the conventional port production method may produce a port, in which, when the sealing plug is sealingly inserted into the port body while it is being tilted, the shape of the port body may not remain constant and hence the sealing plug may fall out of or be pulled out of the port body.

However, according to the method for producing the port 3 and the method for producing the medical liquid bag 1, since the sealing plug 30 is sealingly inserted into the port body 31 in advance and then the fitting part 322 of the pulling-out preventing member 32 which is formed separately from the port body 31 is fitted into the part 312 to be fitted, which is located at a predetermined position, the pulling-out preventing member 32 is attached to the port body 31 at a position appropriate to the sealing plug 30. Therefore, according to the method for producing the port 3 of the present embodiment, it is not necessary to carry out a time-consuming process, such as heating or bending process, and it is possible to suppress occurrence of changing in shape of the port body 31 in the circumferential direction (changing in pressing conditions to the sealing plug 30) so that the sealing plug 30 can be more securely prevented from being pulled out of the port body 31.

Further, since the second surface of the body part 320 is located at the same level as or substantially the same level as (on the plane of) the first surface of the sealing plug 30, it is possible to easily remove maters adhered to the projection part 304 of the sealing plug 30 or the second surface (outer surface) of the body part 320.

Since the pair of sharp pointed parts 311*d* of the part 311*b* to be attached each taper off to a point in the second direction, it is possible to suppress a tension force acting on the pair of sheet members 20 (a tension force acting in a direction in which the pair of sharp pointed parts 311*d* are aligned), when the pair of dies hold therebetween the pair of sheet members 20 along with the part 311*b* to be attached.

Thus, it is possible to allow the pair of sheet members 20 to easily abut against the entire periphery of the part 311*b* to be attached, and hence prevent occurrence of a clearance between the part 311*b* to be attached and the pair of sheet members 20.

It is a matter of course that the present invention is not necessarily limited to the above embodiment, and may be subjected to various modifications within the scope intended by the present invention.

In the above embodiment, the port body 31 has only one single part 310 to be sealed, but this is not essential. For example, the port body 31 may have two or more parts 310 to be sealed. In this case, the sealing plug 30 is sealingly inserted into each of the parts 310 to be sealed, and the pulling-out preventing member 32 is attached to each of the parts 310 to be sealed.

In the above embodiment, the bag body 2 is formed by welding together the outer peripheral edge portions of the pair of sheet members 20 overlapping each other, but this is not essential. For example, the bag body 2 may be formed by closing (for example, welding) the opening portions on the opposite ends of a sheet (or a film) formed into a tubular shape.

In the above embodiment, the bag body 2 and the port 3 are connected by welding, but this is not essential. For example, the bag body 2 and the port 3 may be connected by adhesive or the like.

Figure 12:
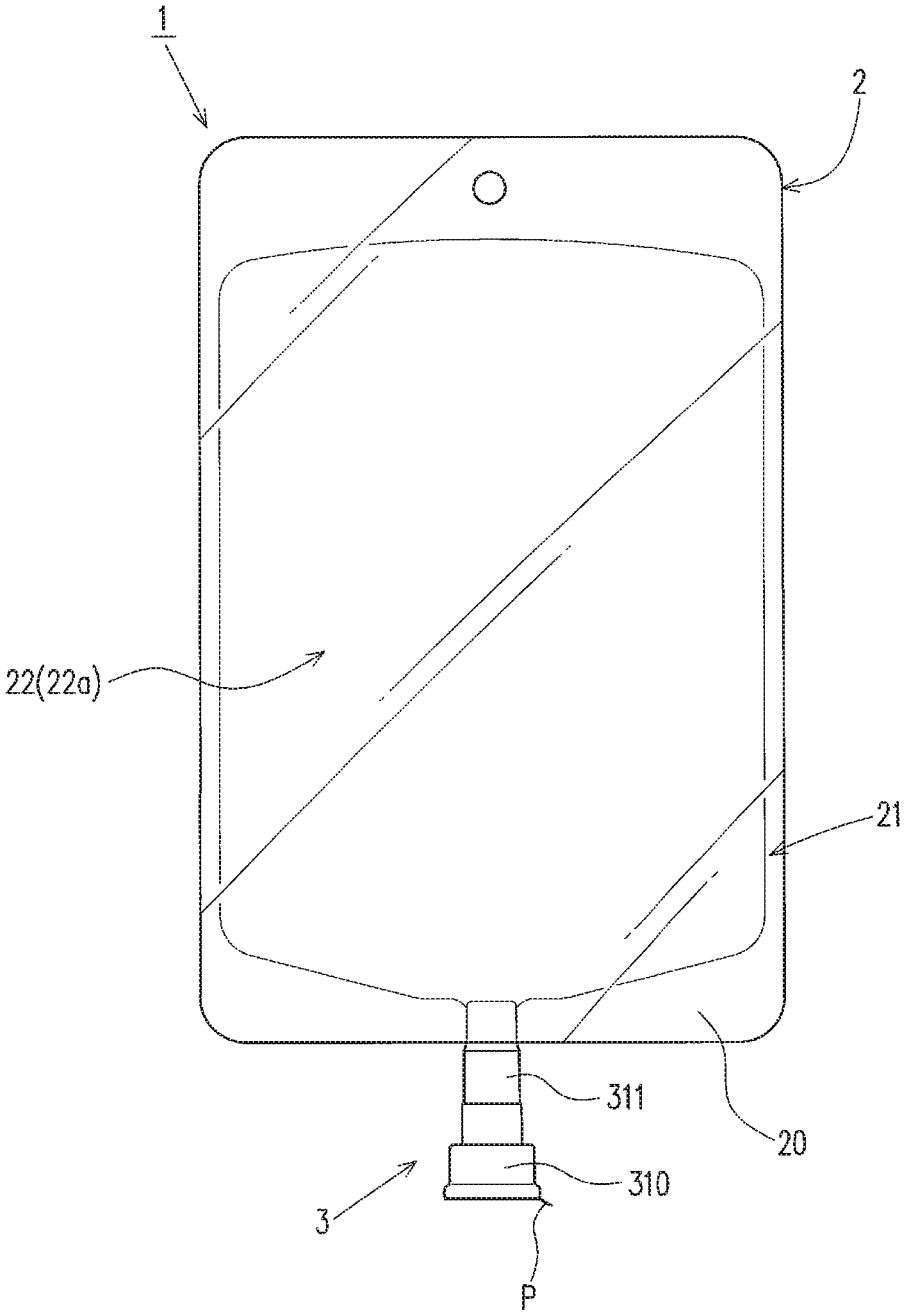
FIG. 12 is a front view of a medical liquid bag according to another embodiment of the present invention.
Figure 13:
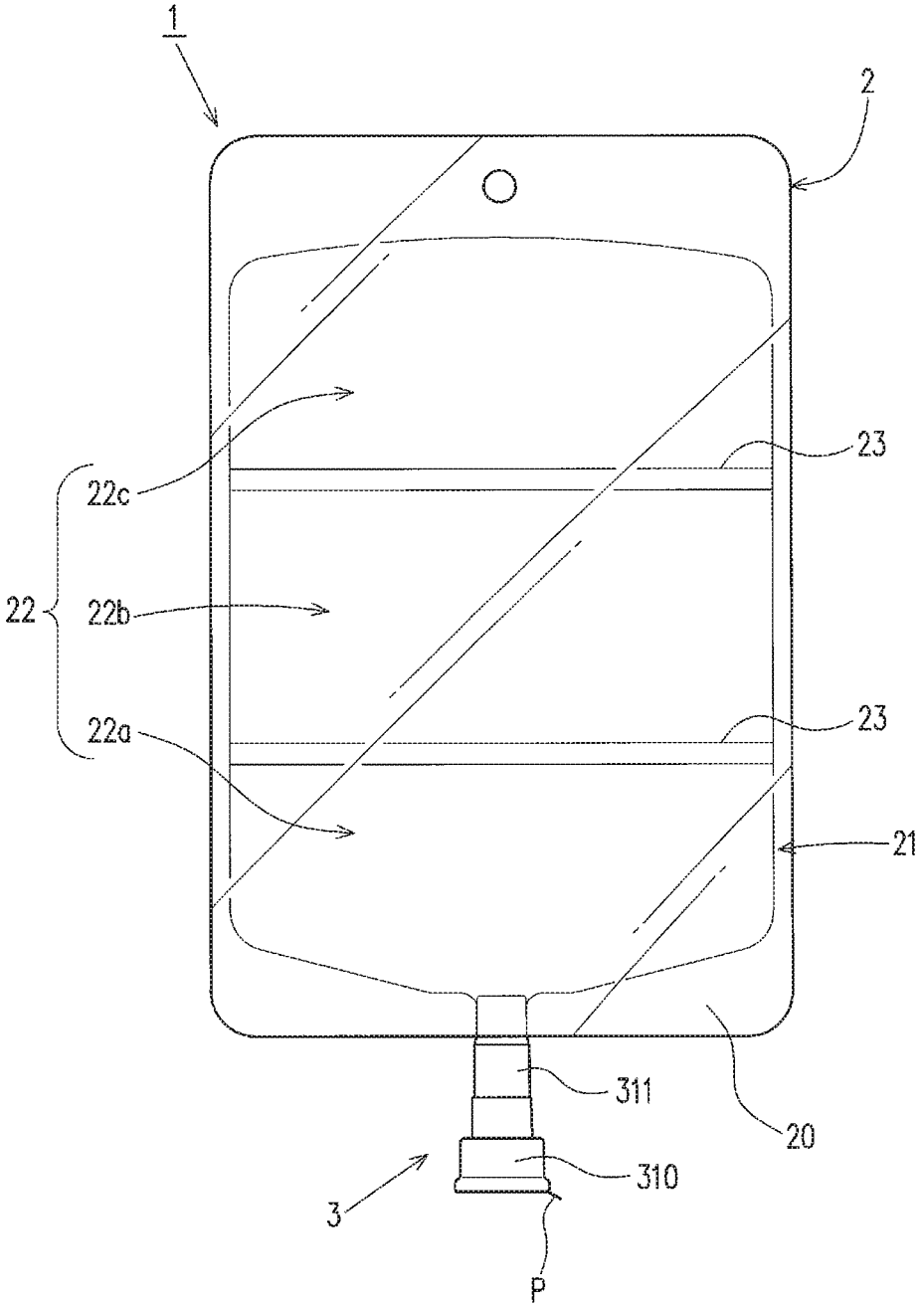
FIG. 13 is a front view of a medical liquid bag according to another embodiment of the present invention.

In the above embodiment, the two spaces (the first storage chamber 22*a* and the second storage chamber 22*b*) are formed within the bag body 2, but this is not essential. For example, the inner space (storage chamber) 22 of the bag body 2 may comprise only one single space as shown in FIG. 12, or it may be partitioned into three or more spaces (storage chambers) 22*a*, 22*b*, 22*c* by the weak seal portions 23, as shown in FIG. 13.

In the above embodiment, the one single port 3 is attached to the medical liquid bag 1, but this is not essential. For example, two or more ports 3 may be attached to the medical liquid bag 1.

In the above embodiment, the center portion (the projection part 304) of the first surface of the sealing plug 30 is located at the same level or substantially the same level as (on the plane of) the second surface of the body part 320, but this is not essential. For example, the center portion (the projection part 304) of the first surface of the sealing plug 30 may project outward from the second surface of the body part 320. Even with this configuration, the center portion of the first surface of the sealing plug 30 can be easily subjected to various workings (e.g., disinfecting with alcohol).

In the above embodiment, the groove 300 of the sealing plug 30 has an annular shape, but this is not essential. The groove 300 may have such a shape as to conform with the shape or configuration of the restriction part 321 projecting toward the sealing plug 30.

Figure 14:
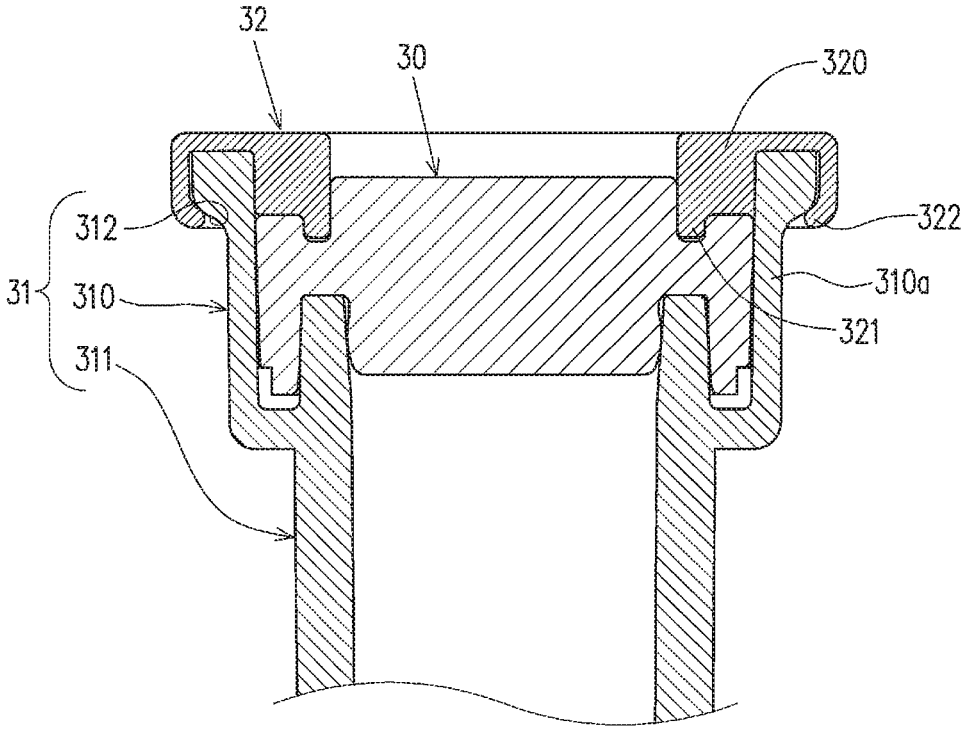
FIG. 14 is a longitudinal cross section of a part of a port according to another embodiment of the present invention.

In the above embodiment, the part 312 to be fitted is formed in the inner peripheral surface on the second end side of the part 310 to be sealed, but this is not essential. For example, the part 312 to be fitted may be formed in the outer peripheral surface of the part 310 to be sealed, as shown in FIG. 14.

In the above case, the pulling-out preventing member 32 may be formed so as to cover the second end side of the part 310 to be sealed, and the fitting part 322 may be formed at a position corresponding to the part 312 to be fitted formed in the outer peripheral surface of the part 310 to be sealed, or may be formed at a position at which the fitting part 322 can be fitted into the part 312 to be fitted.

Figure 15:
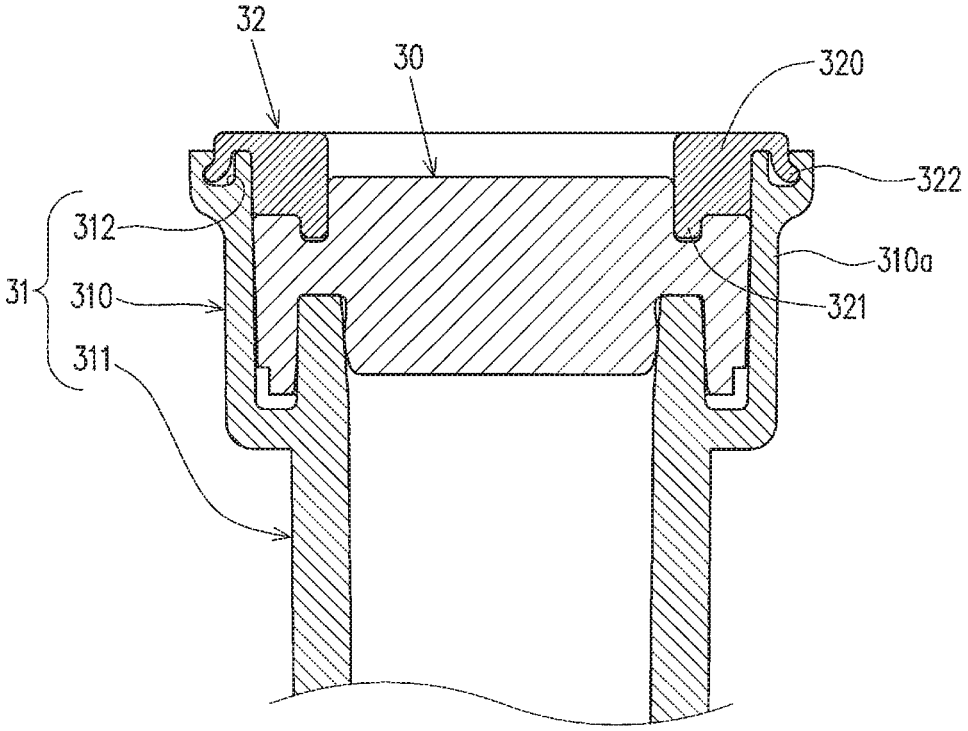
FIG. 15 is a longitudinal cross section of a port according to still another embodiment of the present invention.

As shown in FIG. 15, the part 312 to be fitted may be formed in the second end of the part 310 to be sealed. In this case, it may be configured so that the body part 320 is formed so as to rest on or partially cover the second end of the part 310 to be sealed, and the fitting part 322 is formed at a position corresponding to the part 312 to be fitted formed in the second end, or is formed at a position at which the fitting part 322 can be fitted into the part 312 to be fitted formed in the second end.

In the above embodiment, the part 312 to be fitted is constituted by the recess part (groove) that extends continuously over the entire periphery in the circumferential direction of the inner peripheral surface of the part 310 to be sealed (the outer wall part 310*a*), but this is not essential. For example, the part 312 to be fitted may be formed by plural recess parts formed intermittently in the inner peripheral surface in the circumferential direction. In this case, the fitting part 322 of the pulling-out preventing member 32 may be constituted by plural projection parts formed at positions corresponding respectively to the recess parts of the part 312 to be fitted.

In the above embodiment, the restriction part 321 of the pulling-out preventing member 32 projects toward the sealing plug 30 from the first surface of the body part 320, but this is not essential. The restriction part 321 of the pulling-out preventing member 32 may be formed on the first surface of the body part 320, and, for example, may be constituted by at least a portion of the first surface of the body part 320, provided that the restriction part 321 can abut against the sealing plug 30. In this case, the restriction part 321 is constituted by an area adjacent to the facing area of the first surface, which face area faces the sealing plug 30, or by the facing area itself. The restriction part 321 is not necessarily limited to the configuration in which it extends continuously in the circumferential direction or is formed into an annular shape. For example, plural restriction parts 321 may be provided and are disposed at plural places on the first surface of the body part 320.

In the above embodiment, the restriction part 321 of the pulling-out preventing member 32 abuts against the sealing plug 30, but this is not essential. The restriction part 321 may be disposed to have a clearance between itself and the sealing plug 30. In this case, when the sealing plug 30 is moved toward the second end of the part 310 to be sealed within the part 310 to be sealed, it is matter of course that the restriction part 321 interferes with (abuts against) the sealing plug 30, and the pulling-out preventing member 32 (the restriction part 321) holds the sealing plug 30 within the part 310 to be sealed.

Although not specifically referred in the above embodiment, the pulling-out preventing member 32 and the sealing plug 30 may be separated from each other, or may be connected to each other by, for example, adhesive to be integral with each other. When the pulling-out preventing member 32 and the sealing plug 30 are separated from each other, the pulling-out preventing member 32 is attached to the part 310 to be sealed after the sealing plug 30 is sealingly inserted into the part 310 to be sealed. On the other hand, when the pulling-out preventing member 32 and the sealing plug 30 are connected by, for example, adhesive, the pulling-out preventing member 32 is attached to the part 310 to be sealed at a timing when the sealing plug 30 is sealingly inserted into the part 310 to be sealed.

In the above embodiment, while the body part 320 of the pulling-out preventing member 32 is laid on the first surface of the sealing plug 30, the restriction part 321 is also laid on the first surface side of the sealing plug 30, but this is not essential. It may be configured so that the restriction part 321 is embedded between the first surface and the second surface of the sealing plug 30, and the pulling-out preventing member 32 and the sealing plug 30 are integrally formed. With this configuration, the restriction part 321 of the pulling-out preventing member 32 interferes with or abuts against the sealing plug 30 so that the restriction part 321 restricts movement of the sealing plug 30 toward the second side of the part 310 to be sealed. In this case, the fitting part 322 of the pulling-out preventing member 32 may have a flange shape extending outward from the outer periphery of the sealing plug 30.

When the pulling-out preventing member 32 and the sealing plug 30 are integrally formed, as described above, the body part 320 of the pulling-out preventing member 32 and the sealing plug 30 are laid on each other in advance, and subsequently connected to each other. The configuration intended by the expression "laid on" includes a configuration in which the body part 320 is entirely or partially embedded between the first surface and the second surface of the sealing plug 30, and thereby the body part 320 and the sealing plug 30 are laid on each other, as well as the configuration in which the body part 320 is laid on the first surface of the sealing plug 30. That is, the configuration in which the body part 320 and the sealing plug 30 are laid on each other represents the configuration in which the body part 320 and the sealing plug 30 face each other in the center axis direction of the needle insertion portion of the body part 320 (the direction in which the hollow needle is inserted).

Figure 16:
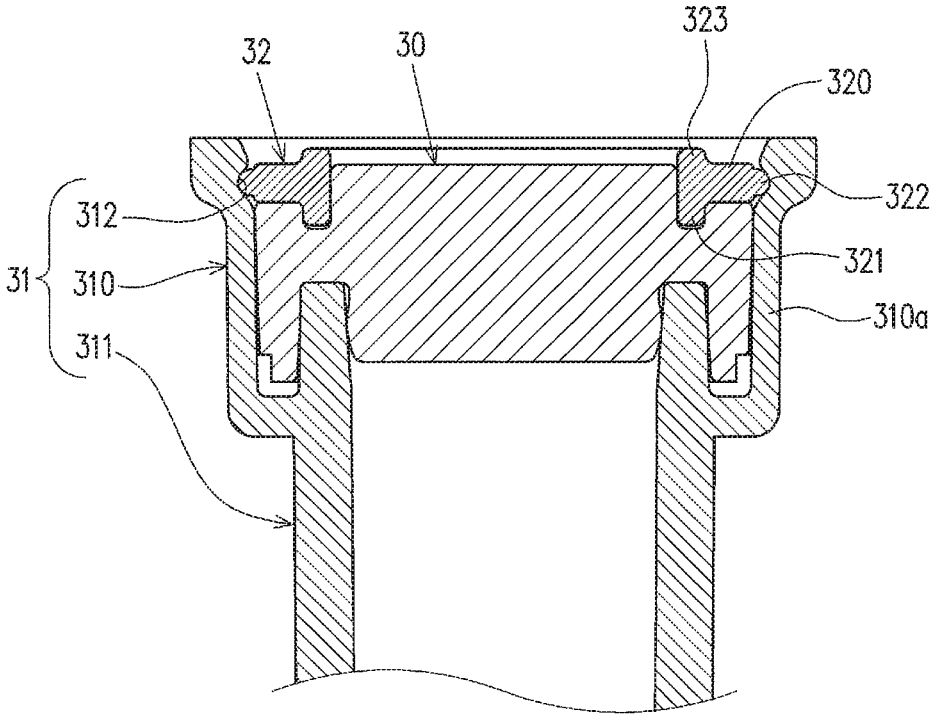
FIG. 16 is a longitudinal cross section of a part of a port according to yet another embodiment of the present invention.

In the above embodiment, the entire area on the second surface side of the body part 320 has a flat surface shape, but this is not essential. For example, as shown in FIG. 16, the pulling-out preventing member 32 may include an annular projection part 323 that projects from the second surface of the body part 320.

In this case, it is preferable that the annular projection part 323 be disposed symmetrical to the restriction part 321 and have a shape symmetrical to the restriction part 321 with reference to a phantom line (or phantom plane) orthogonal to a hole center of the body part 320 and passing through the body part 320.

With the above configuration, the pulling-out preventing member 32 has both sides thereof identical to each other, and therefore, when the pulling-out preventing member 32 is disposed within the part 310 to be sealed while the annular projection part 323 is directed toward the sealing plug 30, the annular projection part 323 functions as a second restriction part. That is, the restriction part 321 projecting from the first surface of the body part 320 becomes a first restriction part and the annular projection part 323 becomes a second restriction part 321. Whereby, when assembling the port 3, it is not necessary to check on which side (a front side or back side) of the pulling-out preventing member 32 faces the right direction, which results in high productivity. Thus, in the method for producing the port 3 and the method for producing the medical liquid bag 1, the step of laying the body part 320 on the sealing plug 30 of the inside of the part 310 to be sealed encompasses the step of bringing the first restriction part 321 or the second restriction part 323 into abutting engagement with the sealing plug 30.

Figure 17:
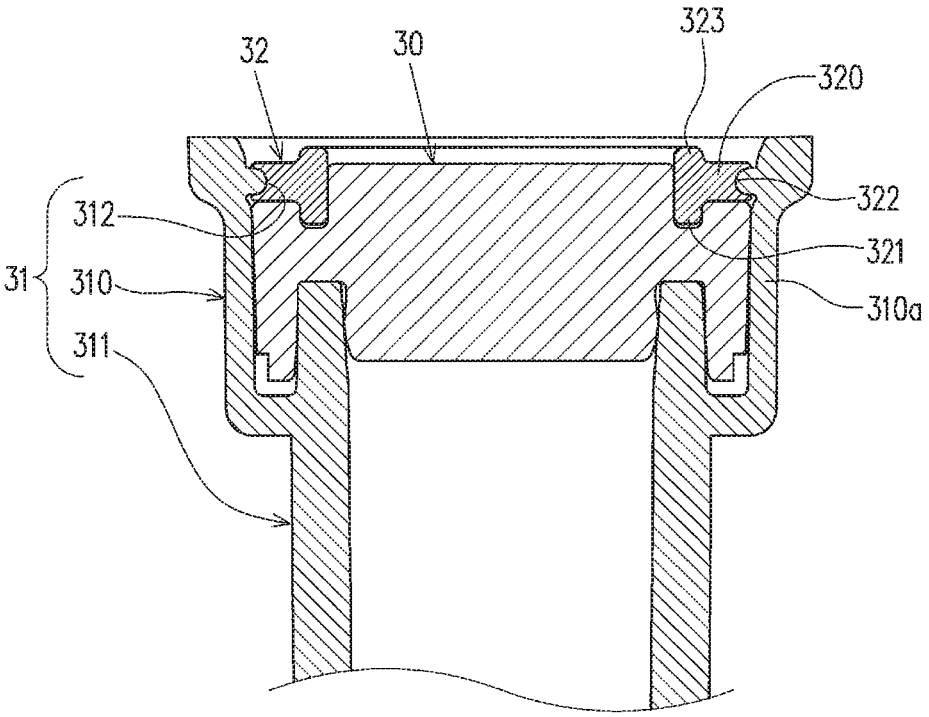
FIG. 17 is a longitudinal cross section of a part of a port according to another embodiment of the present invention.

In the above embodiment, the part 312 to be fitted is constituted by a recess part formed in the inner peripheral surface of the outer wall part 310*a*, but this is not essential. For example, as shown in FIG. 17, the part 312 to be fitted may be a projection part formed on the inner peripheral surface of the part 310 to be sealed (the outer wall part 310*a*). The part 312 to be fitted constituted by the projection part may extend on the inner peripheral surface of the outer wall part 310*a* continuously over the entire periphery in the circumferential direction. In this case, the fitting part 322 may be a recess part into which the projection part, which constitutes the part 312 to be fitted, can be fitted.

Although no specific remark was made in the above embodiment, in a case where the part 312 to be fitted is constituted by any one of the recess part and the projection part formed on the inner peripheral surface of the part 310 to be sealed (the outer wall part 310*a*), and the fitting part 322 is constituted by the remaining one of the recess part and the projection part, it is preferable that the projection part, which constitutes any one of the part 312 to be fitted and the fitting part 322, has a projection amount larger than the recess amount of the recess part. With this configuration, the projection part presses the opposite part, and therefore the pressure contact force between the part 312 to be fitted and the fitting part 322 is increased. Whereby, the pulling-out preventing member 32 is hardly removed from the part 310 to be sealed.

The projection amount of the projection part and the depth of the recess part may be set so that the projection part which constitutes any one of the part 312 to be fitted and the fitting part 322 has a fitting amount (overlapping amount) as large as possible with respect to the recess part which constitutes the remaining one of the part 312 to be fitted and the fitting part 322. With this configuration, the fitting part 322 and the part 312 to be fitted can be securely engaged with each other and hence the pulling-out preventing member 32 is hardly removed from the part 310 to be sealed.

Further, in order to prevent a third party's mischievous behavior or the like, a configuration of blocking forcible removal of the pulling-out preventing member 32 from the part 310 to be sealed may be provided to the port 3.

Figure 18:
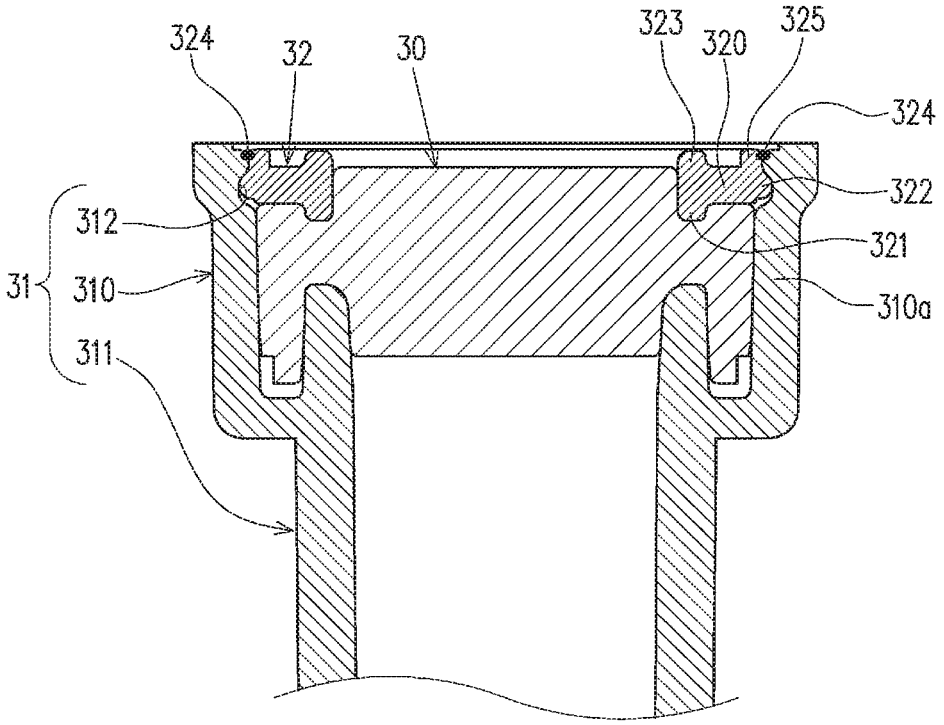
FIG. 18 is a longitudinal cross section of a part of a port according to still another embodiment of the present invention.

For example, as shown in FIG. 18, the port 3 may include a coupling part 324 formed by integrating at least a portion of the part 310 to be sealed and at least a portion of the pulling-out preventing member 32 disposed within the part 310 to be sealed.

In the above case, the pulling-out preventing member 32 and at least the part 310 to be sealed of the port body 31 are formed by a resin or resins which are compatible to each other and specifically can be mixed to each other in melted state. The pulling-out preventing member 32 includes a part 325 to be coupled having a surface being flush with any one of the inner peripheral surface, the outer peripheral surface and an end surface of the part 310 to be sealed (in FIG. 18, an end surface of the part 310 to be sealed) in a state where the pulling-out preventing member 32 is disposed within the part 310 to be sealed. The coupling part 324 is formed by melting and solidifying at least a portion of any one of the inner peripheral surface, the outer peripheral surface and the end surface of the part 310 to be sealed (in FIG. 18, the end surface of the part 310 to be sealed) with at least a portion of the surface of the part 325 to be coupled, which is flush therewith.

The above configuration makes the part 310 to be sealed integral with the pulling-out preventing member 32 fitted into the part 310 to be sealed, and therefore the removal of the pulling-out preventing member 32 is prevented.

Figure 19:
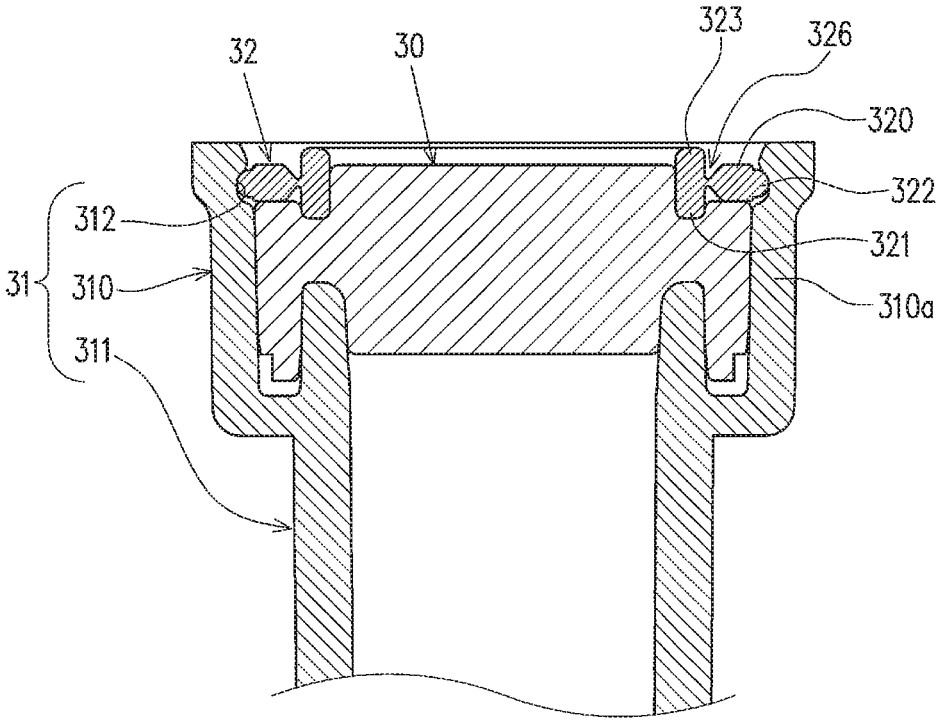
FIG. 19 is a longitudinal cross section of a part of a port according to yet another embodiment of the present invention.

As shown in FIG. 19, the pulling-out preventing member 32 may include a breaking part 326 for breaking the body part 320 along a boundary between the facing area of the first surface of the body part 320 and the area where the restriction part 321 is formed.

In the above case, the breaking part 326 is formed with a strength weaker than the other area of the body part 320 of the pulling-out preventing member 32. For example, the breaking part 326 is formed with a thickness thinner than the other area of the body part 320 of the pulling-out preventing member 32.

With the above configuration, in a case where a malicious third party attempts to remove the pulling-out preventing member 32 by, for example, pulling outward the annular projection 323 with a tool such as pliers, or forcing a tool or the like into the inner peripheral surface side of the body part 320 of the pulling-out preventing member 32, thereby applying a force onto the inner peripheral side of the body part 320 of the pulling-out preventing member 32, the pulling-out preventing member 32 breaks at the breaking part 326 having a weak strength.

Thus, the pulling-out preventing member 32 partially breaks, which indicates a sign of the third party's malicious behavior, so that the medical liquid bag 1 which may have been subjected to such a malicious behavior can also be screened out in advance.

Figure 20:
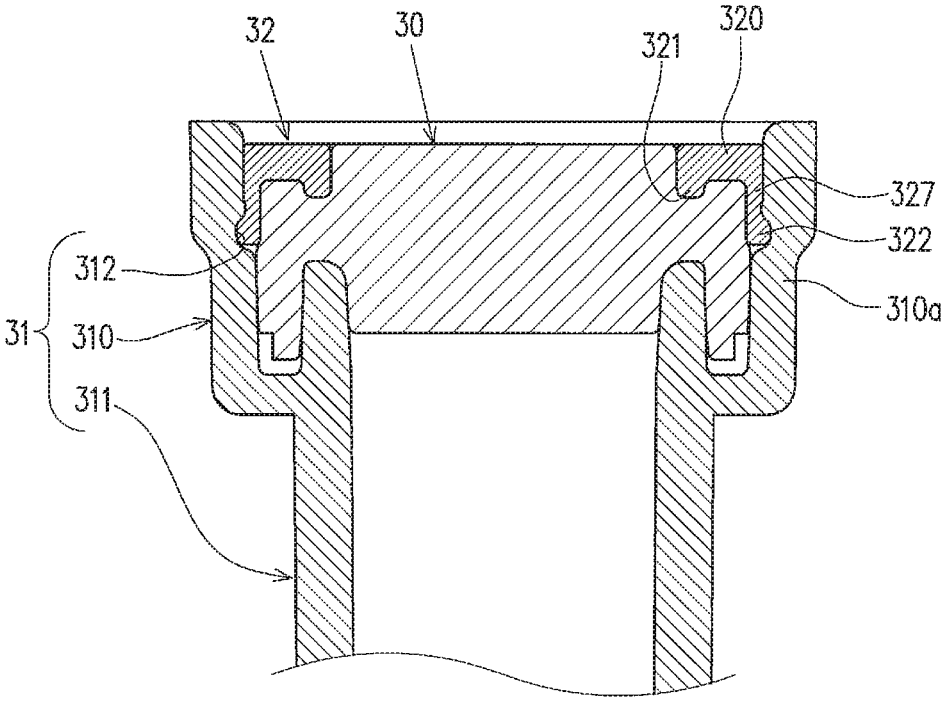
FIG. 20 is a longitudinal cross section of a part of a port according to another embodiment of the present invention.

Also, as shown in FIG. 20, the pulling-out preventing member 32 may include an extension part 327 that is disposed along the part 310 to be sealed (the outer wall part 310*a*), and has a proximal end and a distal end opposite to the proximal end in the center axis direction, in which the proximal end is connected to an outer peripheral end portion of the body part 320 of the pulling-out preventing member 32, and the fitting part 322 may include an extension part 327 that is connected to the distal end.

With the above configuration, the extension part 327 and the fitting part 322 connected to the distal end of the extension part 327 are held between the sealing plug 30 and the part 310 to be sealed (the outer wall part 310*a*). This configuration restricts the movement of the fitting part 322 in a direction in which it falls out of the part 312 to be fitted (the direction orthogonal to the center axis of the part 310 to be sealed).

Thus, even if a malicious third party attempts to remove the pulling-out preventing member 32, it is possible to prevent the fitting part 322 from being detached from the part 312 to be fitted.

That is, in a case where a malicious third party attempts to detach the pulling-out preventing member 32 by, for example, pulling outward the inner peripheral side of the body part 320 of the pulling-out preventing member 32 with a tool, or forcing a tool or the like into the inner peripheral surface side of the body part 320 of the pulling-out preventing member 32, thereby applying a force onto the inner peripheral side of the body part 320 of the pulling-out preventing member 32, an outer peripheral end or its proximal portion of the body part 320 of the pulling-out preventing member 32 acts as an operating point so that the fitting part 322 connected to the distal end of the extension part 327 is going to move in a direction in which the fitting part 322 connected to the distal end of the extension part 327 falls out of the part 312 to be fitted (the direction orthogonal to the center axis of the part 310 to be sealed).

However, as described above, the fitting part 322 is restricted from moving in a direction in which the fitting part 322 falls out of the part 312 to be fitted (the direction orthogonal to the center axis of the part 310 to be sealed), so that the fitting part 322 is blocked from being detached from the part 312 to be fitted.

The fitting part 322 connected to the distal end of the extension part 327 is disposed between the first end and the second end of the part 310 to be sealed (the outer wall part 310*a*) and disposed closer to the first end of the part 310 to be sealed than to the body part 320 of the pulling-out preventing member 32. That is, the fitting part 322 is disposed at a deep position within the part 310 to be sealed. With this configuration, direct access to the fitting part 322 is hardly made, and therefore it is possible to securely prevent a third party's mischievous behavior, such as detaching of the pulling-out preventing member 32 from the part 310 to be sealed.

In the above embodiment, the body part 320 of the pulling-out preventing member 32 has the needle insertion portion formed by the through-hole, but the present invention is not necessarily limited to this. For example, the body part 320 of the pulling-out preventing member 32 may have a needle insertion portion having a cut-out shape, which opens to the first surface and the second surface, and also opens to the outer periphery of the body part 320. That is, the shape of the body part 320 of the pulling-out preventing member 32 is not necessarily limited to an annular shape, and may have a needle insertion portion that opens to the first surface and the second surface, and exposes the sealing plug 30.

Figure 21:
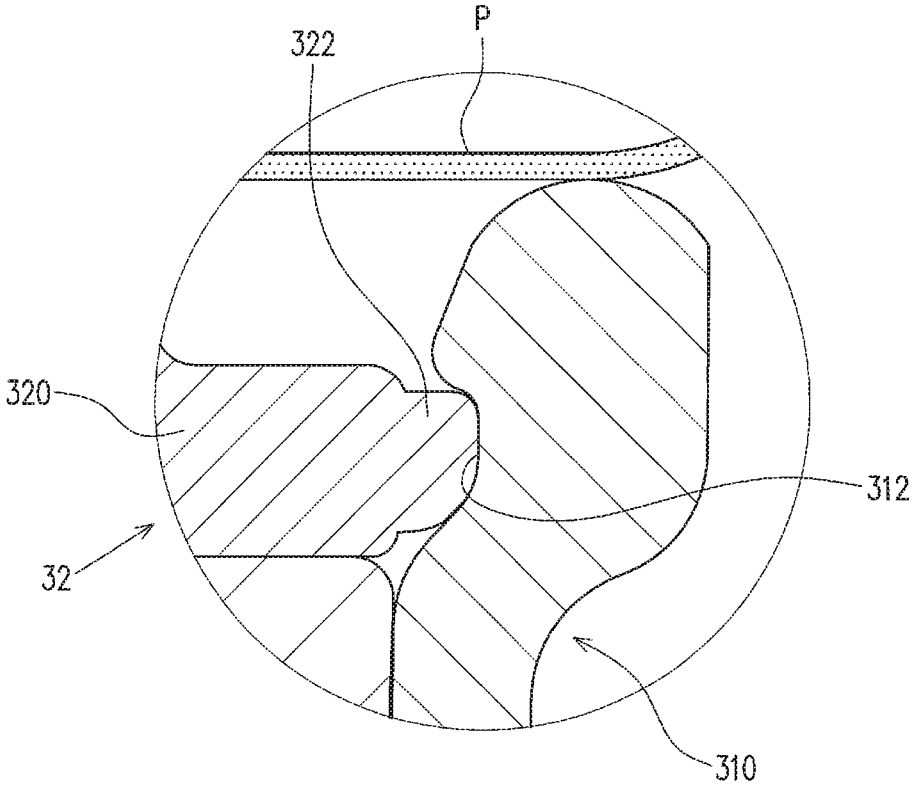
FIG. 21 is a longitudinal cross section of a part of a port according to yet another embodiment of the present invention.
Figure 22:
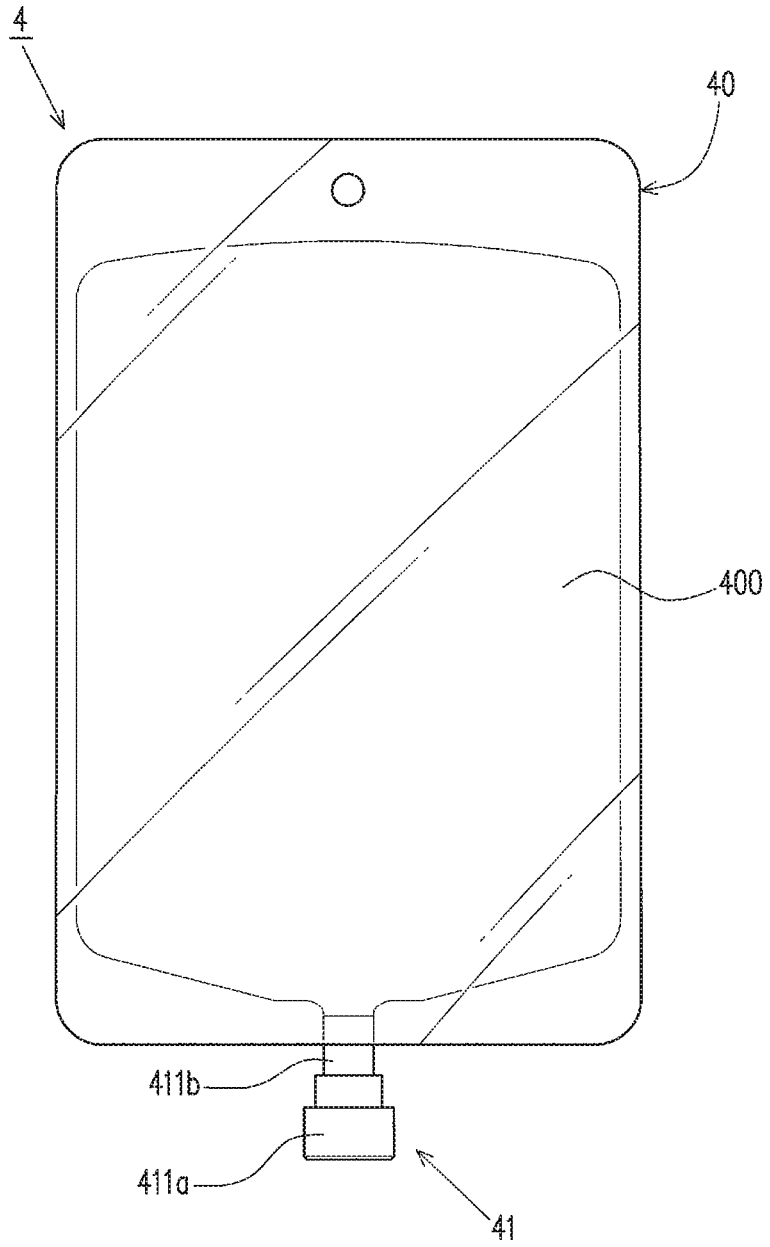
FIG. 22 is a front view of a conventional medical liquid bag.
Figure 23:
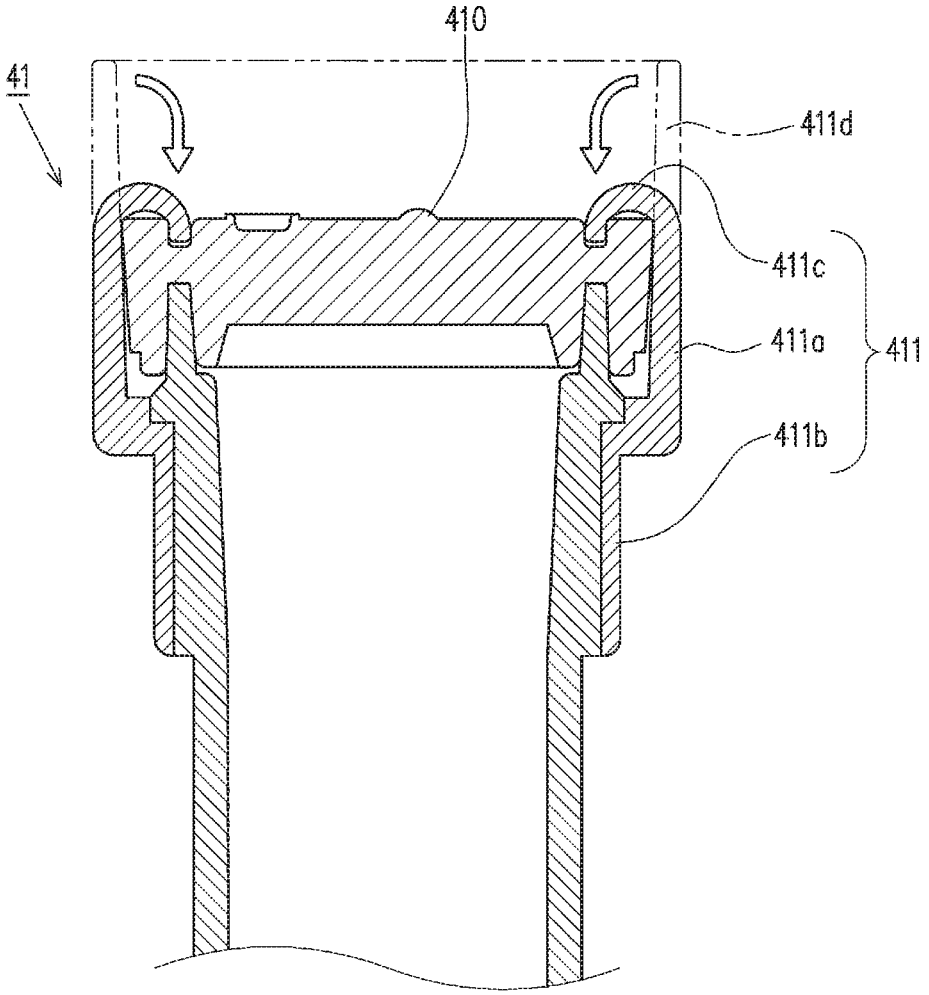
FIG. 23 is a longitudinal cross section of a conventional port.

In the above embodiment, the curvature of the part 312 to be fitted of the port body 31 is set to be smaller than the curvature of the outer peripheral surface of the fitting part 322. This is not essential. For example, as shown in FIG. 21, the curvature of the part 312 to be fitted of the port body 31 may be set to be equal or substantially equal to the curvature of the outer peripheral surface of the fitting part 322.

In the above embodiment, the entire periphery in the circumferential direction of the fitting part 322 of the pulling-out preventing member 32 comes into line contact with or into partial surface contact with the part 312 to be fitted, but this is not essential. For example, the fitting part 322 of the pulling-out preventing member 32 may partially come into contact with the part 312 to be fitted of the port body 31 through plural positions in the circumferential direction of the fitting part 322. That is, the part 312 to be fitted of the port body 31 and the fitting part 322 of the pulling-out preventing member 32 may be configured so as to come into contact with each other through plural positions (places) separated from each other in the circumferential direction.

The part 312 to be fitted and the fitting part 322 are not necessarily limited to the recess part or the projection part. The part 312 to be fitted and the fitting part 322 may be configured so as to be able to transmit a force which is directed in the center axis direction of the part 310 to be sealed, in the state where they are held in fitting engagement with each other. That is, on the premise that the part 312 to be fitted and the fitting part 322 can come into fitting engagement with each other, it may be configured so that the part 312 to be fitted has an engaging surface that has a flat contour or curved contour and is directed toward the one end side of the part 310 to be sealed, and the fitting part 322 has an engaging surface that has a flat contour or curved contour and is directed toward the second end side of the part 310 to be sealed and faces the engaging surface of the part 312 to be fitted.

In the above embodiment, the pulling-out preventing member 32 is attached to the port body 31 after the sealing plug 30 is sealingly inserted into the port body 31, but the present invention is not necessarily limited to this. For example, the pulling-out preventing member 32 may be attached to the port body 31 at the same time as sealingly inserting the sealing plug 30 into the port body 31. That is, the sealing plug 30 and the pulling-out preventing member 32 may be disposed within the port body 31 while they are laid on each other.

In the above embodiment, the bag body 2 (the first storage chamber 22*a*) of the bag body 2 is filled with a medical liquid through the port body 31, but the present invention is not necessarily limited to this.

For example, it may be configured so that, after a medical liquid is injected into the bag body 2 through the non-sealed portion H, the connection part 311 of the port body 31 is inserted into the non-sealed portion H and welded to the bag body 2. Further, it may be configured so that the non-sealed portion H is provided at each of an attaching position to which the port 3 (the port body 31) is attached and a position different from the attaching position, and the port 3 is connected to the non-sealed portion H at the attaching position of the port 3 (the port body 31), and a medical liquid is injected through the other non-sealed portion H and the other non-sealed portion H is sealed. In this case, it may be configured so that the port 3 as a finished product is connected to the non-sealed portion H, or the port 3 as a non-finished product (the port body 31 where the sealing plug 30 or the like is not disposed in the part 310 to be sealed) is connected to the non-sealed portion H, and the port 3 is fabricated into a finished product before a medical liquid is filled through the other non-sealed portion H.

In the above embodiment, when the medical liquid bag 1 is to be produced, the sealing plug 30, the port body 31, and the pulling-out preventing member 32 are separately molded in advance, and they are prepared to be served as parts for constituting the port 3. However, the present invention is not necessarily limited to this. For example, at least one of the sealing plug 30, the port body 31, and the pulling-out preventing member 32 may be formed by molding during a series of steps for producing the medical liquid bag 1.

DESCRIPTION OF THE REFERENCE NUMERALS

1: Medical liquid bag
2: Bag body
3: Port
20: Sheet member
21: Seal part
22: Storage chamber (inner space)
22*a*, 22*b*: Storage chamber (space)
23: Weak seal part
30: Sealing plug
31: Port body
32: Pulling-out preventing member
300: Groove
301: Annular recess part
302: Extension
303: Annular projection part
304: Projection part
310: Part to be sealed
310*a*: Outer wall part
310*b*: Continuous part
310*c*: Support part
311: Connection part
311*a*: Tubular part
311*b*: Part to be attached
311*c*: Circular arc part
311*d*: Sharp pointed part
312: Part to be fitted
320: Body part
321: Restriction part (first restriction part)
322: Fitting part
323: Annular projection part (second restriction part)
324: Coupling part
325: Part to be coupled
326: Breaking part
327: Extension part
H: Non-sealed portion
P: Peelable seal

The invention claimed is:

1. A method for producing a port comprising:

sealingly inserting a sealing plug, through which a hollow needle can be pierced, into a part to be sealed of a port body, wherein the port body includes: the part to be sealed that has a tubular shape with a first end and a second end opposite to the first end in a center axis direction thereof, wherein a recess part is formed in the inner peripheral surface of the part be sealed; a connection part that has a tubular shape, and is continuous with the first end of the part to be sealed; and a part to be fitted that is formed in any one of an inner peripheral surface of the part to be sealed, an outer peripheral surface of the part to be sealed, and the second end of the part to be sealed, wherein the part to be sealed comprises an outer wall part that is formed into a tubular shape with a first end and a second end opposite to the first end in the center axis direction, and the second end side of the outer wall part has a rigidity higher than the rigidity of the first end side of the outer wall part, in such a manner as to be in tight contact with an inner peripheral surface of the outer wall to close a space on an inner side of the outer wall;

fitting a fitting part of a pulling-out preventing member into the part to be fitted, wherein the pulling-out preventing member is a separate member from the sealing plug and includes: a body part that has a first surface and a second surface opposite to the first surface; and the fitting part that is continuous with the body part, to thereby engage the part to be fitted with the fitting part so as to be able to transmit a force which is directed in the center axis of the part to be sealed;

laying the body part on the sealing plug; and applying a peelable seal to the second end of the outer wall part, wherein the part to be sealed comprises a continuous part for connection between the outer wall part and the connection part, and an annular support part that extends from the continuous part toward the second end of the outer wall part, the sealing plug has a first surface located on a side of the pulling-out preventing member and a second surface located opposite to the first surface, and comprises: an extension that extends toward a side opposite to the side of the pulling-out preventing member from a center portion of the second surface; and an annular projection part that surrounds an outer peripheral surface of the extension, the extension and the annular projection part are formed integrally with each other, the annular projection part has a projecting end extending away from the continuous part, and the sealing plug is sealingly inserted into the part to be sealed in a state where the extension is sealingly inserted into or arranged inside the support part and an outer peripheral surface of the annular projection part is in tight contact with the part to be sealed of the port body.

2. The method for producing a port according to claim 1, wherein the part to be fitted is any one of the recess part and a projection part, and the fitting part is a remaining one of the recess part and the projection part.

3. The method for producing a port according to claim 1, wherein the body part has a needle insertion portion that opens to the first surface and the second surface and exposes the sealing plug, wherein the sealing plug includes a projection part that projects toward the needle insertion portion of the body part, and wherein laying the body part on the sealing plug encompasses disposing the projection part of the sealing plug within the needle insertion portion while any one of the first surface and the second surface of the body part is directed toward the sealing plug, and disposing an end of the projection part at the same level as or substantially the same level as a remaining one of the first surface and the second surface of the body part, or at a position where the end of the projection part projects outward from a remaining one of the first surface and the second surface of the body part.

4. The method for producing a port according to claim 2, wherein the body part has a needle insertion portion that opens to the first surface and the second surface and exposes the sealing plug, wherein the sealing plug includes a projection part that projects toward the needle insertion portion of the body part, and wherein laying the body part on the sealing plug encompasses disposing the projection part of the sealing plug within the needle insertion portion while any one of the first surface and the second surface of the body part is directed toward the sealing plug, and disposing an end of the projection part at the same level as or substantially the same level as a remaining one of the first surface and the second surface of the body part, or at a position where the end of the projection part projects outward from a remaining one of the first surface and the second surface of the body part.

5. The method for producing a port according to claim 1, wherein the pulling-out preventing member includes a first restriction part that is formed on the first surface of the body part, and wherein laying the body part on the sealing plug encompasses bringing the first restriction part into abutting engagement with the sealing plug.

6. The method for producing a port according to claim 2, wherein the pulling-out preventing member includes a first restriction part that is formed on the first surface of the body part, and wherein laying the body part on the sealing plug encompasses bringing the first restriction part into abutting engagement with the sealing plug.

7. The method for producing a port according to claim 3, wherein the pulling-out preventing member includes a first restriction part that is formed on the first surface of the body part, and wherein laying the body part on the sealing plug encompasses bringing the first restriction part into abutting engagement with the sealing plug.

8. The method for producing a port according to claim 4, wherein the pulling-out preventing member includes a first restriction part that is formed on the first surface of the body part, and wherein laying the body part on the sealing plug encompasses bringing the first restriction part into abutting engagement with the sealing plug.

9. The method for producing a port according to claim 5, wherein the pulling-out preventing member includes a second restriction part that is formed on the second surface of the body part, and wherein laying the body part on the sealing plug encompasses bringing the second restriction part into abutting engagement with the sealing plug.

10. The method for producing a port according to claim 6, wherein the pulling-out preventing member includes a second restriction part that is formed on the second surface of the body part, and wherein laying the body part on the sealing plug encompasses bringing the second restriction part into abutting engagement with the sealing plug.

11. The method for producing a port according to claim 7, wherein the pulling-out preventing member includes a second restriction part that is formed on the second surface of the body part, and wherein laying the body part on the sealing plug encompasses bringing the second restriction part into abutting engagement with the sealing plug.

12. The method for producing a port according to claim 8, wherein the pulling-out preventing member includes a second restriction part that is formed on the second surface of the body part, and wherein laying the body part on the sealing plug encompasses bringing the second restriction part into abutting engagement with the sealing plug.

13. A method for producing a medical liquid bag comprising:

sealingly inserting a sealing plug, through which a hollow needle can be pierced, into a part to be sealed of a port body, wherein the port body includes: the part to be sealed that has a tubular shape with a first end and a second end opposite to the first end in a center axis direction thereof, wherein a recess part is formed in the inner peripheral surface of the part be sealed; a connection part that has a tubular shape, and is continuous with the first end of the part to be sealed; and a part to be fitted that is formed in any one of an inner peripheral surface of the part to be sealed, an outer peripheral surface of the part to be sealed, and the second end of the part to be sealed, wherein the part to be sealed comprises an outer wall part that is formed into a tubular shape with a first end and a second end opposite to the first end in the center axis direction, and the second end side of the outer wall part has a rigidity higher than the rigidity of the first end side of the outer wall part, in such a manner as to be in tight contact with an inner peripheral surface of the outer wall to close a space on an inner side of the outer wall;

fitting a fitting part of a pulling-out preventing member into the part to be fitted, wherein the pulling-out preventing member is a separate member from the sealing plug and includes: a body part that has a first surface and a second surface opposite to the first surface; and the fitting part that is continuous with the body part, to thereby engage the part to be fitted with the fitting part so as to be able to transmit a force which is directed in the center axis of the part to be sealed;

laying the body part on the sealing plug;

connecting a bag body to be filled with a medical liquid to an outer periphery of the connection part; and applying a peelable seal to the second end of the outer wall part, wherein the part to be sealed comprises a continuous part for connection between the outer wall part and the connection part, and an annular support part that extends from the continuous part toward the second end of the outer wall part, the sealing plug has a first surface located on a side of the pulling-out preventing member and a second surface located opposite to the first surface, and comprises: an extension that extends toward a side opposite to the side of the pulling-out preventing member from a center portion of the second surface; and an annular projection part that surrounds an outer peripheral surface of the extension, the extension and the annular projection part are formed integrally with each other, the annular projection part has a projecting end extending away from the continuous part, and the sealing plug is sealingly inserted into the part to be sealed in a state where the extension is sealingly inserted into or arranged inside the support part and an outer peripheral surface of the annular projection part is in tight contact with the part to be sealed of the port body.

14. The method for producing a port according to claim 13, wherein the part to be fitted is any one of a recess part and a projection part, and the fitting part is a remaining one of the recess part and the projection part.

15. The method for producing a medical liquid bag according to claim 13, further comprising: filling a medical liquid into the bag body via the port body to which the connection part of the bag body is connected, wherein sealingly inserting the sealing plug into the part to be sealed and laying the body part on the sealing plug are carried out after the medical liquid is filled in the bag body.

16. The method for producing a medical liquid bag according to claim 14, further comprising: filling a medical liquid into the bag body via the port body to which the connection part of the bag body is connected, wherein sealingly inserting the sealing plug into the part to be sealed and laying the body part on the sealing plug are carried out after the medical liquid is filled in the bag body.

17. The method for producing a medical liquid bag according to claim 13, wherein a non-sealed portion provided in the bag body is sealed after the medical liquid is filled in the bag body through the non-sealed portion.

18. The method for producing a medical liquid bag according to claim 14, wherein a non-sealed portion provided in the bag body is sealed after the medical liquid is filled in the bag body through the non-sealed portion.

19. The method for producing a medical liquid bag according to claim 17, wherein connecting the bag body to the outer periphery of the connection part encompasses sealing the non-sealed portion by welding the non-sealed portion to the connection part disposed at the non-sealed portion.

20. The method for producing a medical liquid bag according to claim 18, wherein connecting the bag body to the outer periphery of the connection part encompasses sealing the non-sealed portion by welding the non-sealed portion to the connection part disposed at the non-sealed portion.

* * * * *